US011547228B2

(12) United States Patent
Levin

(10) Patent No.: US 11,547,228 B2
(45) Date of Patent: Jan. 10, 2023

(54) OYSTER OPENER, MULTI-FUNCTIONAL OYSTER OPENER, OYSTER PROCESSING SYSTEM, AND/OR PORTABLE OYSTER PROCESSING DEVICE

(71) Applicant: Eric Martin Levin, Severna Park, MD (US)

(72) Inventor: Eric Martin Levin, Severna Park, MD (US)

( * ) Notice: Subject to any disclaimer, the term of this patent is extended or adjusted under 35 U.S.C. 154(b) by 0 days.

(21) Appl. No.: 17/363,980

(22) Filed: Jun. 30, 2021

(65) Prior Publication Data

US 2022/0296017 A1 Sep. 22, 2022

Related U.S. Application Data

(60) Provisional application No. 63/162,070, filed on Mar. 17, 2021.

(51) Int. Cl.
*A47G 21/00* (2006.01)
*A47G 21/06* (2006.01)

(52) U.S. Cl.
CPC ..... *A47G 21/062* (2013.01)

(58) Field of Classification Search
CPC ..... A47G 21/062
USPC ..... 452/12, 13, 16
See application file for complete search history.

(56) References Cited

U.S. PATENT DOCUMENTS

| | | | | | |
|---|---|---|---|---|---|
| 1,212,464 | A * | 1/1917 | Edwards | A47G 21/062 | 83/605 |
| 1,857,872 | A * | 5/1932 | Robinson | A47G 21/062 | 452/16 |
| 2,052,231 | A * | 8/1936 | Kanzler | A47G 21/062 | 452/16 |
| 2,296,049 | A * | 9/1942 | Plate | A47G 21/062 | 99/581 |
| 2,571,214 | A * | 10/1951 | Dean | A47J 43/26 | 99/578 |
| 3,151,352 | A * | 10/1964 | Hagen | A47G 21/062 | D7/680 |
| 4,255,835 | A * | 3/1981 | Demulder | A47G 21/062 | 452/16 |
| 7,993,186 | B1 * | 8/2011 | Rotello | A22C 29/046 | 452/17 |

* cited by examiner

*Primary Examiner* — Richard T Price, Jr.
(74) *Attorney, Agent, or Firm* — Garcia-Zamor Intellectual Property Law, LLC; Ruy Garcia-Zamor

(57) ABSTRACT

An oyster opener device, system, kit, and/or method which preferably greatly enhances the ease and enjoyment of preparing oysters or other shellfish. The oyster opener may be entirely manually powered, manually powered and free of all motors and electrical components, may be operated by a powered device, may include a motor, or may be operated manually with a powered assist.

20 Claims, 14 Drawing Sheets

FIG. 16
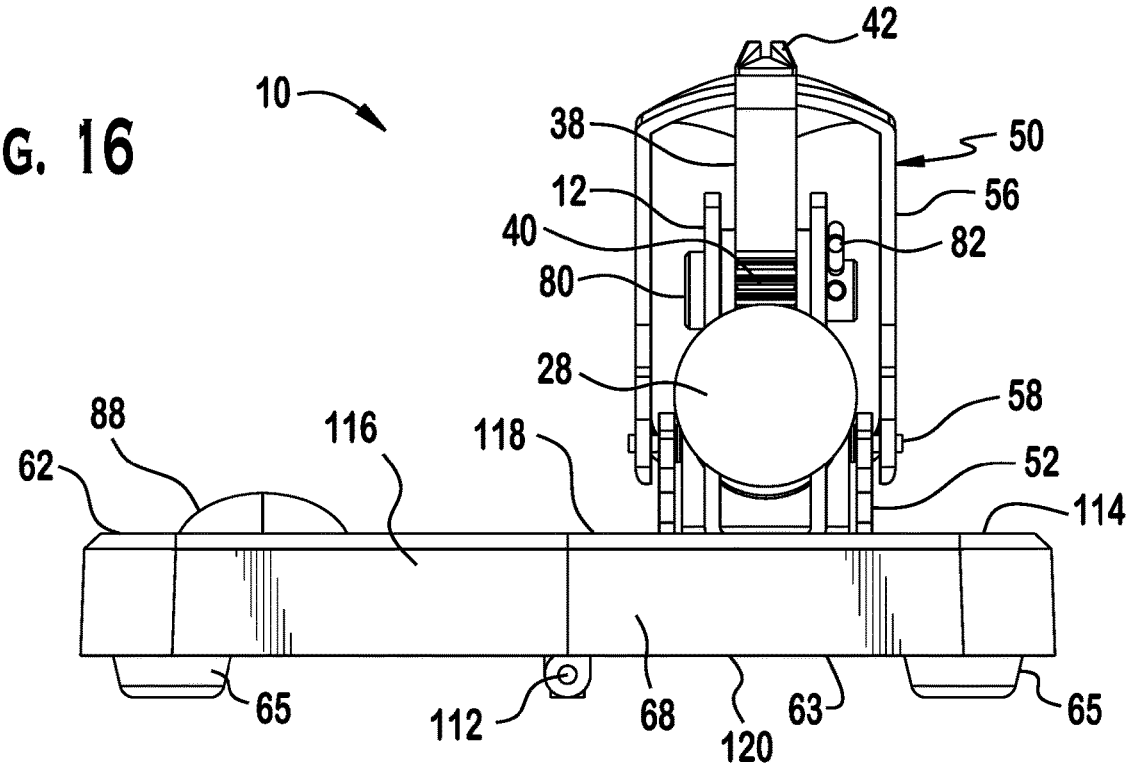
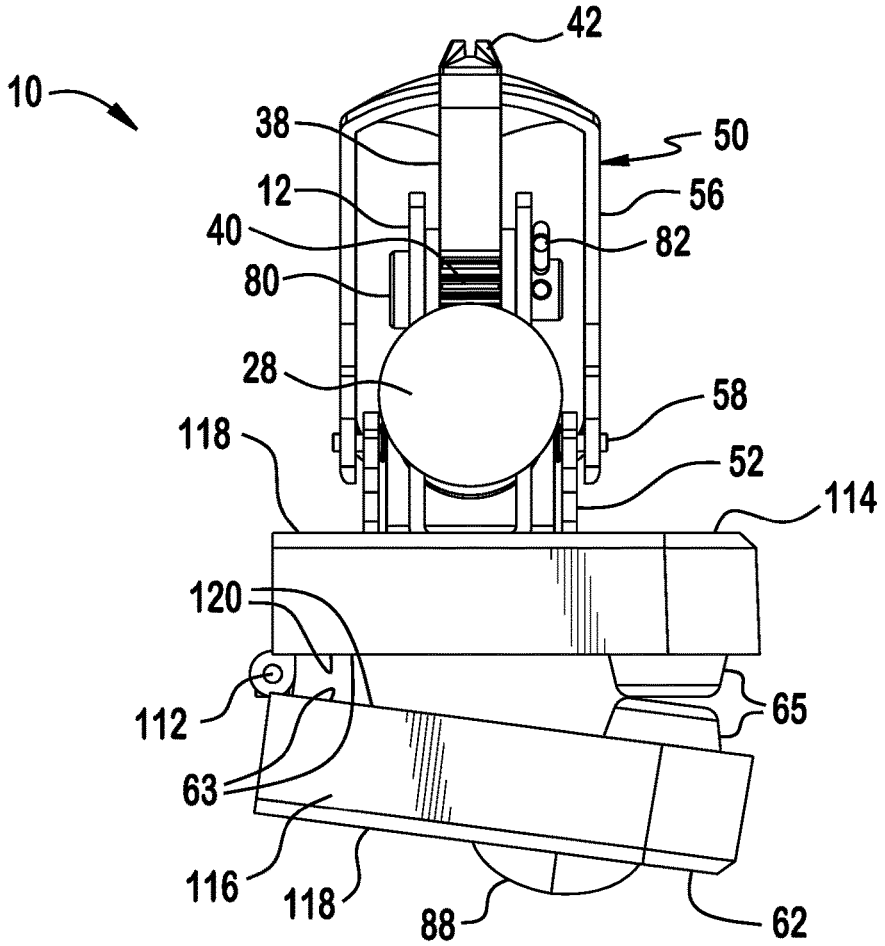
FIG. 17

OYSTER OPENER, MULTI-FUNCTIONAL OYSTER OPENER, OYSTER PROCESSING SYSTEM, AND/OR PORTABLE OYSTER PROCESSING DEVICE

CROSS REFERENCE TO RELATED APPLICATIONS

This application claims priority to and benefit of U.S. Provisional Patent No. 63/162,070, filed Mar. 17, 2021, which is hereby incorporated by reference in its entirety as if fully set forth herein.

BACKGROUND

The preferred embodiments of the present invention relate generally to oyster openers. More specifically, the preferred embodiment of the present invention relates to a lever-actuated, rack-and-pinion oyster opener device. The present invention may also relate to a method of opening oysters using a lever-actuated, rack-and-pinion oyster opener device.

Typically, oysters are opened using a traditional oyster knife. However, using oyster knife or other sharp utensil can be dangerous to the user because of the potential for slippage and the infliction of self-injury. In order to efficiently open oysters using these rudimentary methods, the oysters are often tilted or tipped. When the oysters are tilted or tipped, the oysters lose most, if not all, of the natural juices. Additionally, oysters are often tiled when opening to simplify holding the oyster in a hand while using an oyster knife to split the oyster via the hinge. When opening an oyster via the hinge, it is usual that even more natural oyster fluid is lost. This has a further drawback of making it harder to pry open the oyster because the hinge is tougher to penetrate and crack. Oyster openers still usually go through the hinge, however, because it is easier to find the seam when viewing the hinge.

It may be advantageous to provide an oyster opener and/or oyster opening system and/or oyster opening method which may preferably, but not necessarily: be configured to split the oyster via the bill; take advantage of a rack and pinion, or similar mechanism, to facilitate applying force to the oyster; be manually operated without the use of motors or electrical components; which may incorporate a motor such that the splitting operation is governed by the selection of a control, such as a button; be easy to clean; be at least partially collapsible to facilitate packing, shipping, and/or storage; be visually attractive; be suitable for use waterside or in boats; be sturdy enough for commercial use; use replaceable wedges; include a baseboard with recesses for implements and/or utensils; be efficient for manufacture; allow the opening of oysters without manually holding the oyster; also include a mechanism for providing an initial crack in the oyster prior to splitting; hold an oyster in a generally horizontal configuration; minimize the amount of natural oyster fluid lost during the opening process; be useful for use by people with limited strength or of advanced age; and/or be easy to use.

SUMMARY

Briefly speaking, one embodiment of the present invention is directed to an oyster opening device. The oyster opening device may comprise a housing defining a channel therein. The housing may have first and second housing axial ends. The oyster opening device may further comprise a rod having first and second rod axial ends. The rod may be moveably located in the channel along a drive axis. The oyster opening device may also comprise a wedge positioned on the second rod axial end. The oyster opening device may additionally comprise a lever and a holder. The lever may be positioned on the housing and configured to drive the rod along the drive axis. The lever may be configured to move through an arcuate path about the housing. The holder may be positionally fixed relative to the housing. The oyster opener device may be configured to hold an oyster. When the lever is rotated in a first direction along the arcuate path toward the first housing axial end, the rod may be driven along the drive axis toward the holder. The oyster opening device may then be configured to split open the oyster positioned thereon when the wedge is driven toward the holder.

In a separate aspect, the present invention is directed to an oyster opening device. The oyster opening device may comprise a housing defining a channel therein. The housing may have first and second housing axial ends. The housing may further comprise an oyster contact plate. The lever may have a snipper thereon. When the lever is rotated in a second direction along the arcuate path toward the second housing axial end, the snipper may be moved toward the oyster contact plate. The snipper and the oyster contact plate may be configured to form a crack in an unopened oyster positioned therebetween.

In a separate aspect, the present invention is directed to an oyster opening device. The oyster opening device may comprise a housing defining a channel therein. The housing may further comprise an oyster contact plate. The lever may have a snipper thereon. When the lever is rotated in a second direction along the arcuate path toward the second housing axial end, the snipper may be moved toward the oyster contact plate. The snipper and the oyster contact plate may be configured to form a crack in an unopened oyster positioned therebetween. The oyster opening device may also comprise a wedge positioned on the second rod axial end. A tip of the wedge may be configured for placement into the crack of the oyster to facilitate stability in the holding thereof when the wedge splits the oyster.

In a separate aspect, the present invention is directed to an oyster opening device. The oyster opener device may be configured to hold the oyster in a generally flat and horizontal position during splitting to reduce an amount of oyster fluid which leaves the oyster during splitting.

In a separate embodiment, the present invention is directed to an oyster opening device. The oyster opener device may be configured to hold the oyster in a generally flat and horizontal position during splitting to reduce an amount of oyster fluid which leaves the oyster during splitting. The oyster may be abuttingly positioned between the holder and wedge. The holder may be positioned along the drive axis.

In a separate embodiment, the present invention is directed to an oyster opening device. The oyster opening device may further comprise a rod having first and second rod axial ends. The rod may be moveably located in the channel along a drive axis. The oyster opening device may also comprise a wedge positioned on the second rod axial end. The wedge may comprise a horizontal blade and a vertical ramp. The horizontal blade may extend further from the rod along the drive axis than the vertical ramp. The vertical ramp assisting the horizontal blade in splitting open the oyster.

In a separate embodiment, the present invention is directed to an oyster opening device. The oyster opening device may comprise a lever. The lever may be positioned on the housing and configured to drive the rod along the drive axis. The lever may be configured to move through an arcuate path about the housing. The oyster opener device may be configured such that rotation of the lever in the first direction toward the first housing axial end only drives the rod and the wedge toward the holder if the rotation of the lever creates a compressive force between the lever and the supporting surface.

In a separate embodiment, the present invention is directed to an oyster opening device. The oyster opening device may comprise a lever. The lever may be positioned on the housing and configured to drive the rod along the drive axis. The lever may be configured to move through an arcuate path about the housing. The lever may comprise a handle portion. The oyster opener device may be configured for placement on a supporting surface. The lever may only drive the rod the rod toward the holder once the handle portion has been rotated along the arcuate path in the first direction past substantial perpendicularity with the supporting surface.

In a separate embodiment, the present invention is directed to an oyster opening device. The oyster opening device may comprise a lever. The lever may be positioned on the housing and configured to drive the rod along the drive axis. The lever may be configured to move through an arcuate path about the housing. The lever may comprise a handle portion. The oyster opener device may be configured for placement on a supporting surface. The lever may only drive the rod the rod toward the holder once the handle portion has been rotated along the arcuate path in the first direction past substantial perpendicularity with the supporting surface by at least twenty) (20°) degrees.

In a separate embodiment, the present invention is directed to an oyster opening device. The oyster opening device may comprise a housing defining a channel therein. The housing may have first and second housing axial ends. The housing may have an axial guide partially defining the channel. A protuberance may be located on the first rod axial end. The protuberance may be configured to abut the axial guide to prevent the rod from moving completely past the first housing axial end when moving toward the second housing axial end.

In a separate embodiment, the present invention is directed to an oyster opening device. The oyster opening device may a holder. The holder may be positionally fixed relative to the housing. The oyster opener device may be configured to hold an oyster. The holder may have a holder base which defines a groove therein. The groove may be configured to receive a portion of the oyster therein. The holder may further comprise a hand grip. The hand grip may be pivotally attached to the holder base. The hand grip may be configured to press down on the oyster abutting the holder base.

In a separate embodiment, the present invention is directed to an oyster opening device. The oyster opening device may comprise a baseboard configured to contact a supporting surface. The baseboard may be foldable along a longitudinal axis parallel to the drive axis to form first and second baseboard sections. The first baseboard section may have first and second major surfaces. The baseboard may be foldable such that the oyster opening device and the holder are positioned on the first major surface of the first baseboard section. The second baseboard section may be folded against the second major surface of the first baseboard section.

In a separate embodiment, the present invention is directed to an oyster opening device. The oyster opening device may further comprise a rod having first and second rod axial ends. The rod may be moveably located in the channel along a drive axis. The oyster opening device may also comprise a wedge positioned on the second rod axial end. The wedge may be detachably positioned on the second rod axial end.

In a separate embodiment, the present invention is directed to an oyster opening device. The oyster opening device may further comprise a baseboard. The housing and the holder may be positioned on the baseboard. The baseboard may define a slot. The slot may be configured to store a utensil such as an oyster knife.

In a separate embodiment, the present invention is directed to an oyster opening device. The oyster opening device may comprise a housing defining a channel therein. The housing may have first and second housing axial ends. The housing may further comprise an oyster contact plate. The lever may have a snipper thereon. When the lever is rotated in a second direction along the arcuate path toward the second housing axial end, the snipper may be moved toward the oyster contact plate. The snipper and the oyster contact plate may be configured to form a crack in an unopened oyster positioned therebetween. The oyster contact plate may further define a blade configured to form a point contact with the oyster. The point contact may engage an opposite side of the oyster from the snipper to assist the snipper in forming the crack.

In a separate embodiment, the present invention is directed to an oyster opening device. The oyster opening device may comprise a lever. The lever may have a gear-like section thereon. The gear-like section may be at least partially located within the housing. The rod may have a plurality of splined grooves configured to engage the gear-like section of the lever.

In a separate embodiment, the present invention is directed to a method of opening an oyster. The method may comprise the step of positioning the oyster such that it is fixed in a generally flat and horizontal position. The method may also comprise the step of driving a wedge positioned on a rod into the oyster to split the oyster while the oyster is free of actual physical contact by a person and while the blade and rod are free of actual physical contact by the person. The wedge may be driven into the oyster while maintaining the oyster in the generally flat and horizontal position such that the amount of oyster fluid leaving the oyster during splitting is reduced.

In a separate embodiment, the present invention is directed to a method of opening an oyster. The method may also comprise the step of driving a wedge by applying a force along an arcuate path to drive the wedge along a drive axis into the oyster.

In a separate embodiment, the present invention is directed to an oyster opening device. The oyster opening device may comprising a housing having first and second housing axial ends. The housing may have an axial guide and an oyster contact plate. The axial partially may define a channel. The oyster opening device may also comprise a baseboard configured to contact a supporting surface. The housing may be positioned on the baseboard. The oyster opening device may further comprise a rod having first and second rod axial ends. The rod may be moveably located in the channel along a drive axis. The rod may define a plurality of splined grooves therein. The oyster opening device may comprise a wedge positioned on the second rod axial end. A protuberance may be located on the first rod axial end. The protuberance may be configured to abut the axial guide to prevent the rod from moving completely past the first housing axial end when moving toward the second housing end. A lever may be positioned on the housing and may be configured to drive the rod along the drive axis. The lever may be configured to move through an arcuate path about the housing. The lever may further comprise a handle portion, a gear-like section, and a snipper. The gear-like section may be at least partially located within the housing. A holder may be positioned on the baseboard and may be axially aligned with the rod. The gear-like section may be configured to engage the plurality of splined grooves such that when the lever is rotated in a first direction along the arcuate path toward the first housing axial end the rod is driven along the drive axis toward the holder. The oyster opening device may be configured to split open the oyster positioned thereon when the wedge is driven toward the holder. When the lever is rotated in a second direction along the arcuate path toward the second housing axial end, the snipper may be moved toward the oyster contact plate. The snipper and the oyster contact plate may be configured to form a crack in an unopened oyster positioned therebetween.

In a separate embodiment, the present invention is related to a device for opening hard-shelled objects. The device may comprise a wedge for splitting open the shell. The device may be a rack-and-pinion capable of translating rotational force of a lever to a linear force in a rod. The rod may have a wedge at one end. The wedge may be a sharp blade. The hard-shelled object may be held flatly while it is being pried open by the wedge.

In a separate embodiment, the present invention is related to a lever-actuated, rack-and-pinion oyster opener device. The oyster opener device may comprise a piston-actuated rack and pinion oyster opener device. The oyster opener device may be permanently affixed to a tabletop, countertop, or other household, industrial, or restaurant surface where opening oysters efficiently and with reduced spillage of natural oyster juice is desired.

In a separate embodiment, the present invention is related to a device for opening hard-shelled objects. The device may comprise a wedge for splitting open the shell. The device may be a rack-and-pinion capable of translating rotational force of a lever to a linear force in a rod. The rod may have a wedge at one end. The wedge may be a sharp blade. The hard-shelled object may be held flatly while it is being pried open by the wedge. The device may be entirely manually driven and be free of any motors, hydraulics, or electrical devices.

In a separate embodiment, the present invention is directed to an oyster opening device. The oyster opening device may comprise a housing defining a channel therein. The housing may have first and second housing axial ends. The oyster opening device may further comprise a rod having first and second rod axial ends. The rod may be moveably located in the channel along a drive axis. The oyster opening device may also comprise a wedge positioned on the second rod axial end. The oyster opening device may additionally comprise a lever and a holder. The lever may be positioned on the housing and configured to drive the rod along the drive axis. The lever may be configured to move through an arcuate path about the housing. The holder may be positionally fixed relative to the housing. The oyster opener device may be configured to hold an oyster. When the lever is rotated in a first direction along the arcuate path toward the first housing axial end, the rod may be driven along the drive axis toward the holder. The oyster opening device may then be configured to split open the oyster positioned thereon when the wedge is driven toward the holder. The device may be entirely manually/hand driven and be free of (and/or not use) any motors, hydraulics, or electrical devices.

In a separate embodiment, the present invention is directed to an oyster opening device. The oyster opening device may comprise a housing defining a channel therein. The housing may have first and second housing axial ends. The oyster opening device may further comprise a rod having first and second rod axial ends. The rod may be moveably located in the channel along a drive axis. The oyster opening device may also comprise a wedge positioned on the second rod axial end. The oyster opening device may additionally comprise a motor, hydraulic system, or the like which automatically drives the rod in response to the operation of a controller by a user. The motor may be attached to housing directly, located therein, or may be in fluid or electric communication therewith. The holder may be positionally fixed relative to the housing. The oyster opener device may be configured to hold an oyster. When the control is activated the rod may be driven along the drive axis toward the holder. The oyster opening device may then be configured to split open the oyster positioned thereon when the wedge is driven toward the holder.

In a separate embodiment, the present invention is directed to an oyster opening device. The oyster opening device may comprise a housing defining a channel therein. The housing may have first and second housing axial ends. The oyster opening device may further comprise a rod having first and second rod axial ends. The rod may be moveably located in the channel along a drive axis. The oyster opening device may also comprise a wedge positioned on the second rod axial end. The oyster opening device may additionally comprise a motor, hydraulic system, or the like which automatically drives the rod in response to the operation of a controller by a user. The motor may be attached to housing directly, located therein, or may be in fluid or electric communication therewith. When the control is activated the rod may be driven along the drive axis toward the holder. The oyster opening device may then be configured to split open the oyster.

In a separate embodiment, the present invention is directed to an oyster opening device. The oyster opening device may comprise a housing defining a channel therein. The housing may have first and second housing axial ends. The oyster opening device may further comprise a rod having first and second rod axial ends. The rod may be moveably located in the channel along a drive axis. The oyster opening device may also comprise a wedge positioned on the second rod axial end. The oyster opening device may additionally comprise a motor, hydraulic system, or the like which automatically drives the rod in response to the operation of a controller by a user. The motor may be attached to housing directly, located therein, or may be in fluid or electric communication therewith. When the control is activated the rod may be driven along the drive axis toward the holder. The oyster opening device may then be configured to split open the oyster. The controller may be remotely located such as a desk mounted switch, or a software module on an electronic device/computer, or via a mobile application on a phone or tablet.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. At least one of the embodiments of the present invention is accurately represented by this application's drawings which are relied on to illustrate such embodiment(s) to scale and the drawings are relied on to illustrate the relative size, proportions, and positioning of the individual components of the present invention accurately relative to each other and relative to the overall embodiment(s). Those of ordinary skill in the art will appreciate from this disclosure that the present invention is not limited to the scaled drawings and that the illustrated proportions, scale, and relative positioning can be varied without departing from the scope of the present invention as set forth in the broadest descriptions set forth in any portion of the originally filed specification and/or drawings. It is understood, however, that the invention is not limited to the precise arrangements and instrumentalities shown. In the drawings:

FIG. 16 is a back view of an oyster opening device 10 in an alternative preferred embodiment. The foldable baseboard 110 preferably forms a first major surface 118 along the baseboard top 62. The foldable baseboard 110 also may form a second major surface 120 along the baseboard bottom 63. The baseboard hinge 112 can be more clearly seen connecting the first baseboard section 114 to the second baseboard section 116. The foldable baseboard 110 is shown in an extended position so that the oyster opening device 10 may be operated by a user.

FIG. 17 is a back view of an oyster opening device 10 in an alternative preferred embodiment. The foldable baseboard 110 can be seen in a folded position. In the folded position, the second major surface 120 of the second baseboard section 116 may be rotated about the baseboard hinge 112 until it contacts the second major surface 120 of the first baseboard section 114. As this figure depicts, the feet 65 of the baseboard 60 may prevent the first baseboard section 114 from fully contacting the second baseboard section 116.

DETAILED DESCRIPTION OF THE PREFERRED EMBODIMENT

Figure 1:
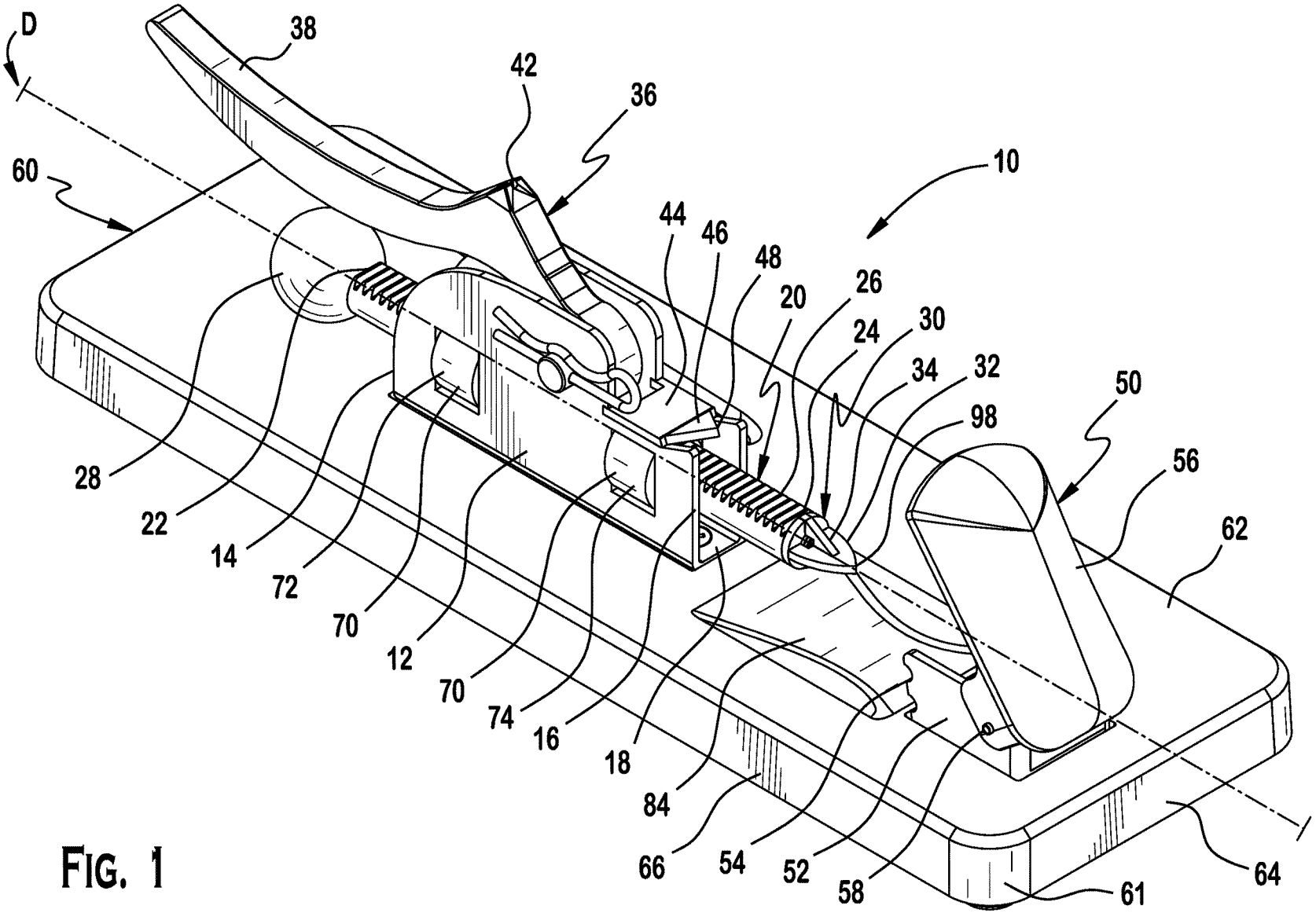
FIG. 1 is a front perspective view of an oyster opening device 10 in the preferred embodiment. This figure shows the oyster opening device 10 comprising a housing 12. The housing 12 preferably comprises a first housing axial end 14 and a second housing axial end 16 on opposite ends of the housing 12. Extending within the housing 12 from the first housing axial end 14 to the second housing axial end 16 is preferably a channel 18 defined therethrough. Extending through the channel 18 may be a rod 20. The rod 20 extends outwardly from the first housing axial end 14 and can form a first rod axial end 22. In the opposite direction, the rod 20 may extend outwardly from the second housing axial end 16 and form a second rod axial end 24. The rod 20 preferably extends along a drive axis D. A lever 36 may be connected to the housing 12 and contacts the rod 20. The housing 12, the rod 20, and the lever 36 may form a driving unit 100. The housing 12 is shown connected to a baseboard 60. The baseboard 60 also supports and is connected to a holder 50. The device may be entirely manually/hand driven and be free of (and/or not use) any motors, hydraulics, or electrical devices.
Figure 2:
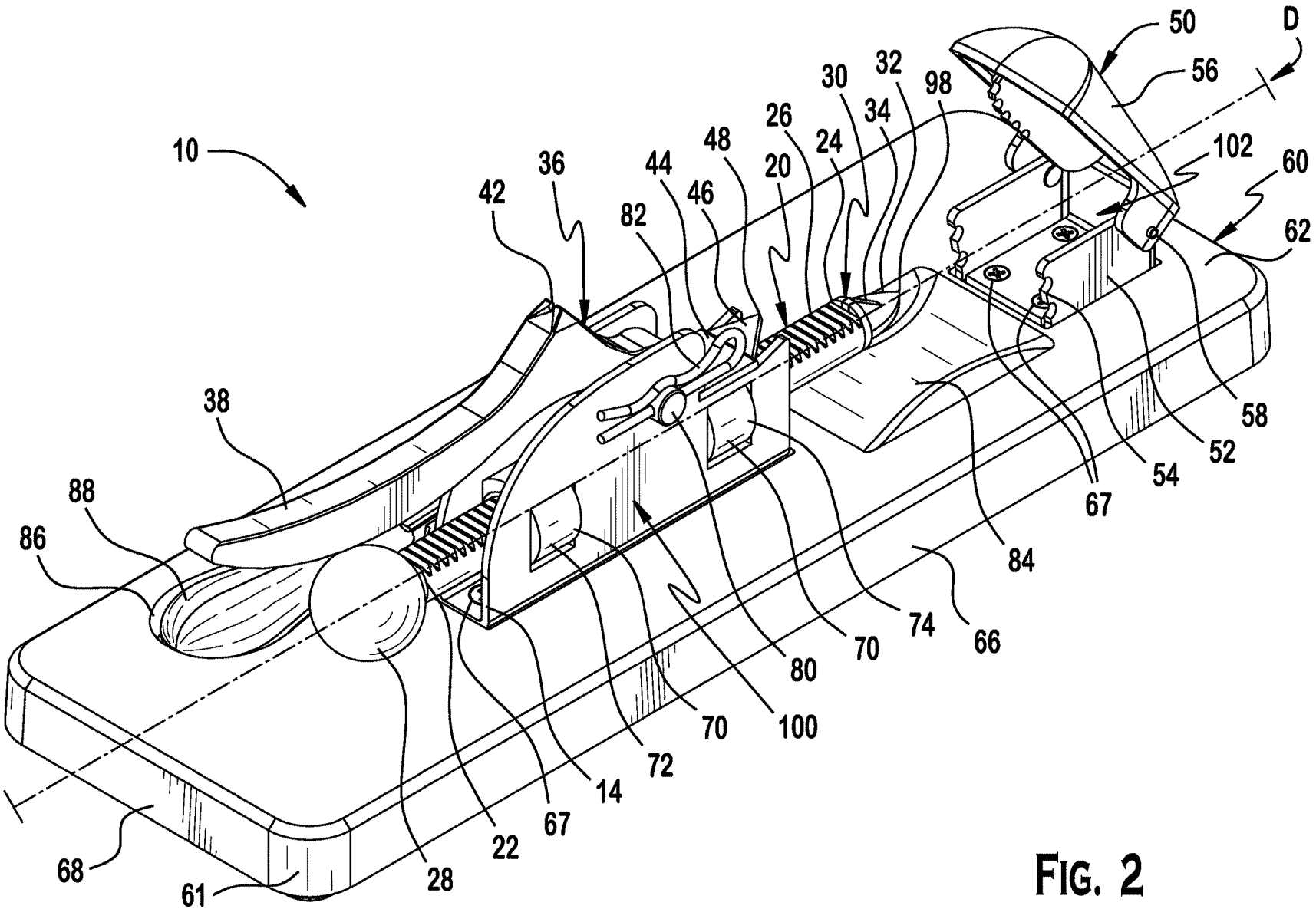
FIG. 2 is a back perspective view of an oyster opening device 10 in the preferred embodiment. This figure illustrates the holder 50 being connected to the baseboard top 62 and located toward the baseboard front 64 of the baseboard 60. The holder 50 may comprise a holder base 52 which supports the handgrip 56. The handgrip 56 may be connected to the holder base 52 by a holder hinge 58. The holder base 52 may further define grooves 54. The holder 50 may be connected to the baseboard top 62 via a plurality of fasteners 67 that extend through the baseboard 60. The handgrip 56, the holder base 52, and the indentation 84 may form the holding portion 102.
Figure 3:
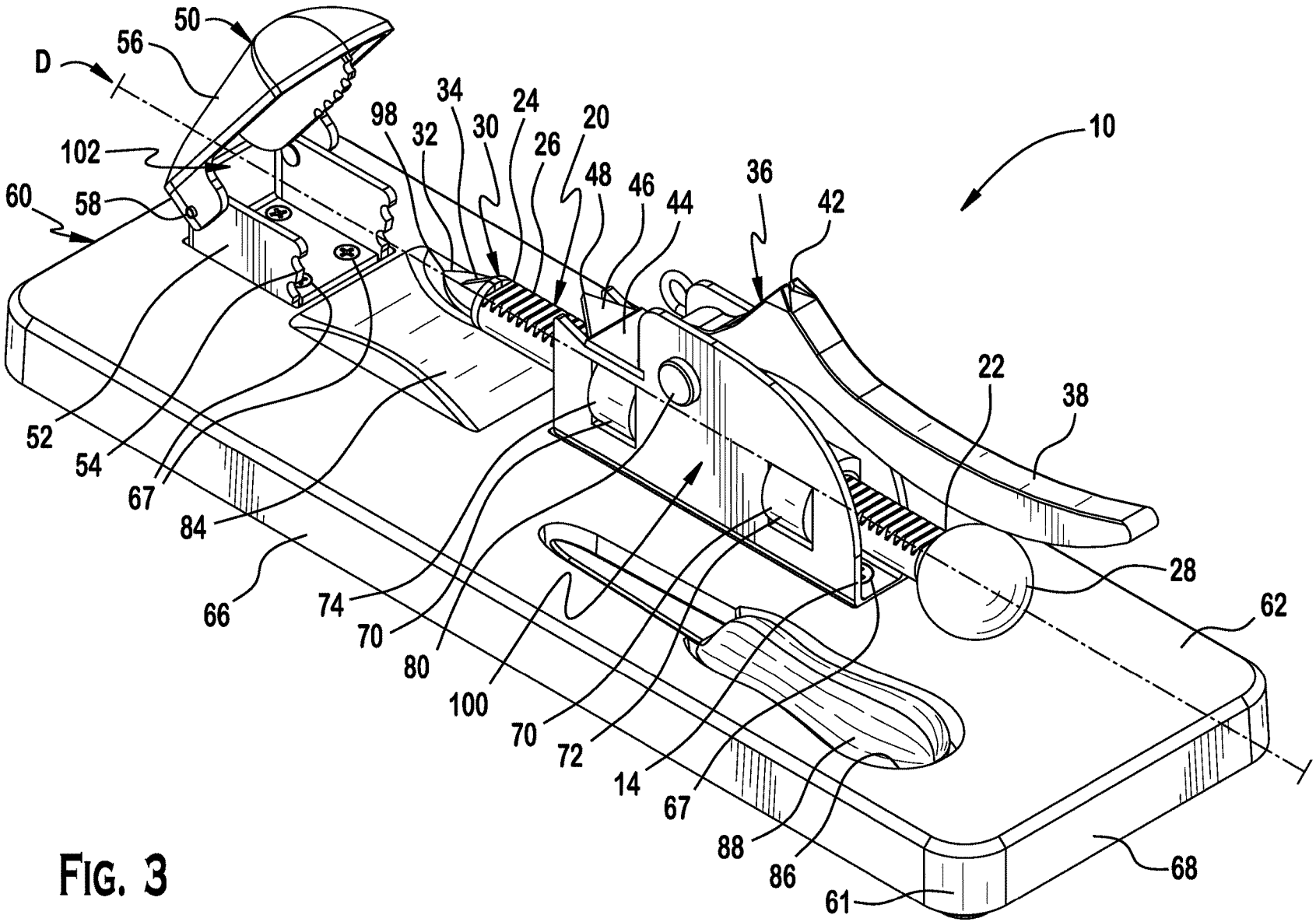
FIG. 3 is an alternative back perspective view of an oyster opening device 10 in the preferred embodiment. This figure illustrates a slot 86 defined in the baseboard top 62 of the baseboard 60. The slot may accommodate a utensil 88, such as an oyster knife. The slot 86 may be located toward the baseboard back 68 and toward a baseboard side 66. Additionally, the first rod axial end 22 may attach to a protuberance 28. The protuberance 28 is preferably wider than the channel 18 to prevent the rod 20 from fully axially sliding through the housing 12 and disengaging from the device 10.
Figure 4:
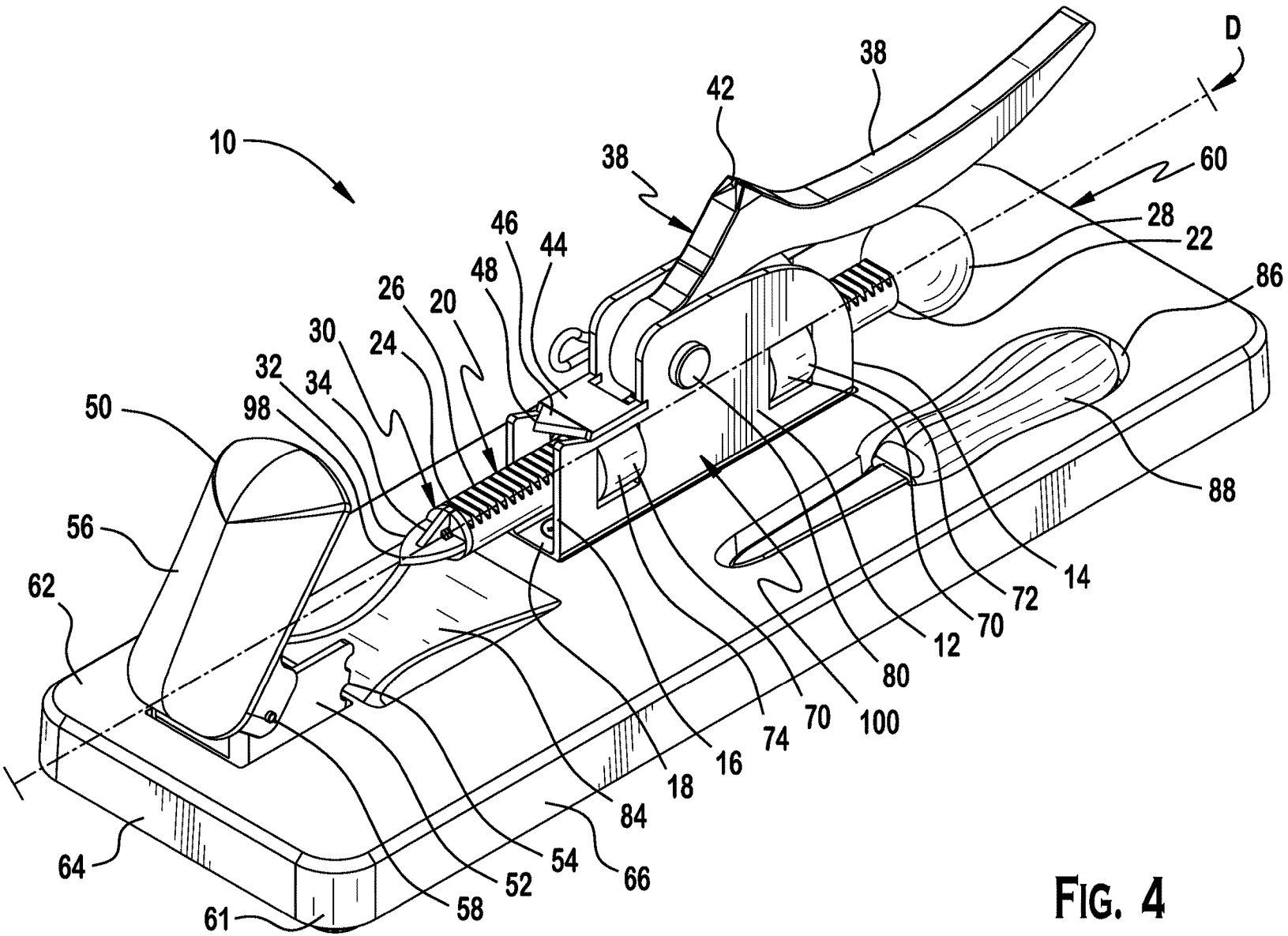
FIG. 4 is an alternative front perspective view of an oyster opening device 10 in the preferred embodiment. This figure shows the rod 20 comprising a plurality of splined grooves 26 extending along the length. The second rod axial end 24 may also attach to a wedge 30. The wedge 30, designed to split open an oyster, may preferably comprise a horizontal blade 32 and a vertical ramp 34. To further accommodate an oyster 90, the baseboard top 62 preferably defines an indentation 84 along the drive axis D located between the housing 12 and the holder 50. The baseboard 60 may comprise a baseboard front 64 and rounded corners 61.
Figure 5:
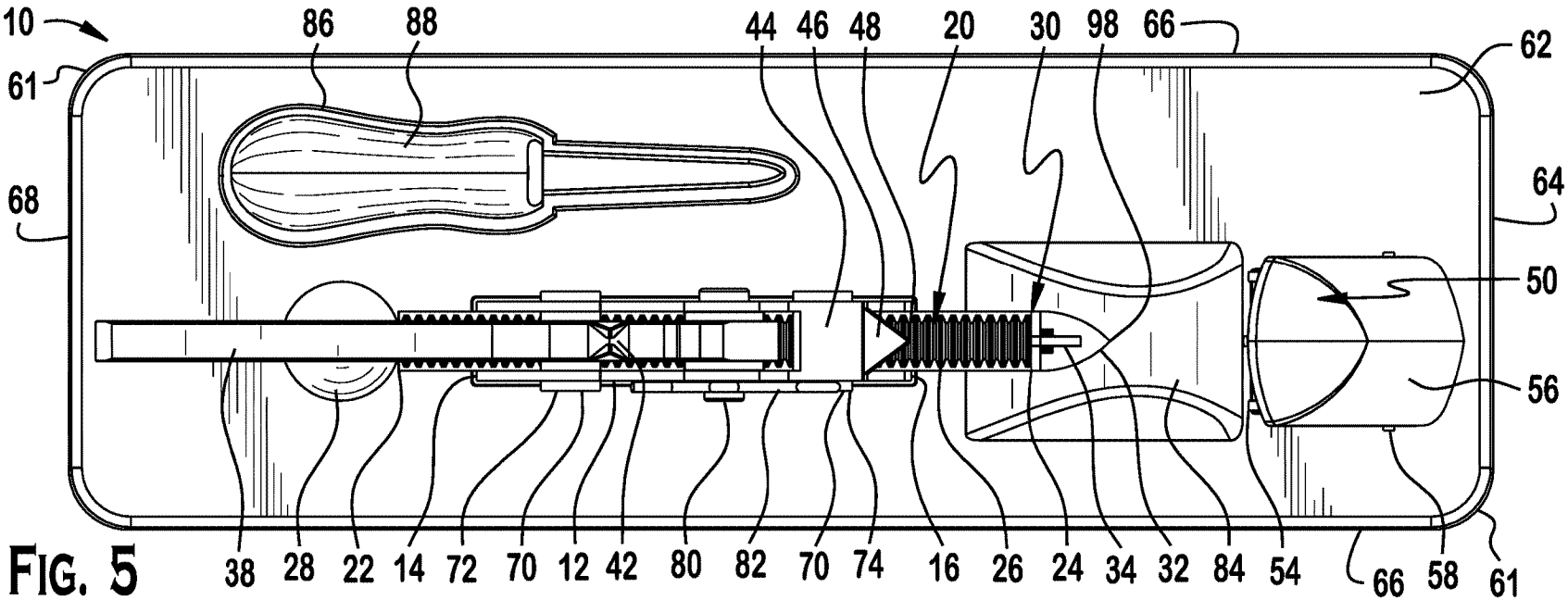
FIG. 5 is a top view of an oyster opening device 10 in the preferred embodiment. Here, the channel 18 preferably extending through the housing 12 can be more clearly seen. The rod 20 may preferably extend through the channel 18. The housing 12 may also form an oyster contact plate 44. The oyster contact plate 44 may comprise a blade 46. The blade 46 preferably forms a point contact 48.
Figure 6:
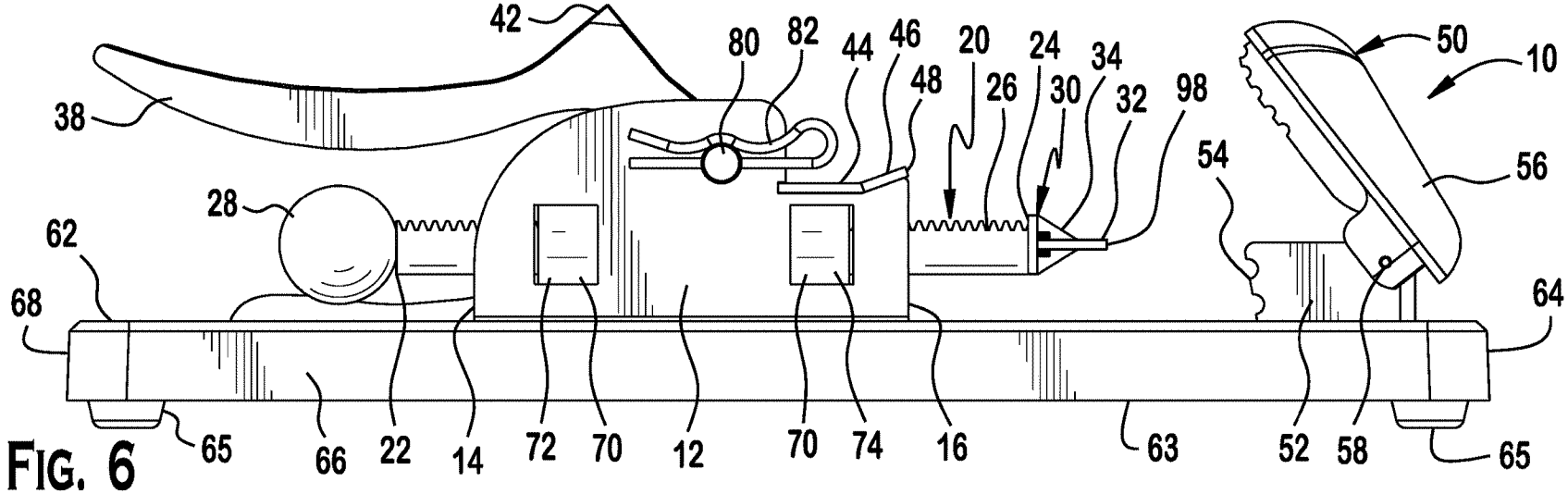
FIG. 6 is a left-side view of an oyster opening device 10 in the preferred embodiment. This figure illustrates the lever 36 attached to the housing 12. The lever 36 preferably comprises a handle portion 38. The handle portion 38 can be engaged by a user of the device 10. The lever 36 may also form a snipper 42. The snipper 42 is preferably configured to pinch and crack a portion of an oyster shell between itself and the point contact 48 of the oyster contact plate 44. The lever 36 may also be connected to the housing 12 by a bolt 80. The bolt 80 may allow for rotation of the lever 36 about the housing 12. The bolt 80 may extend through the housing 12 perpendicular to the drive axis D. The bolt 80 may be held in place by a pin 82.
Figure 7:
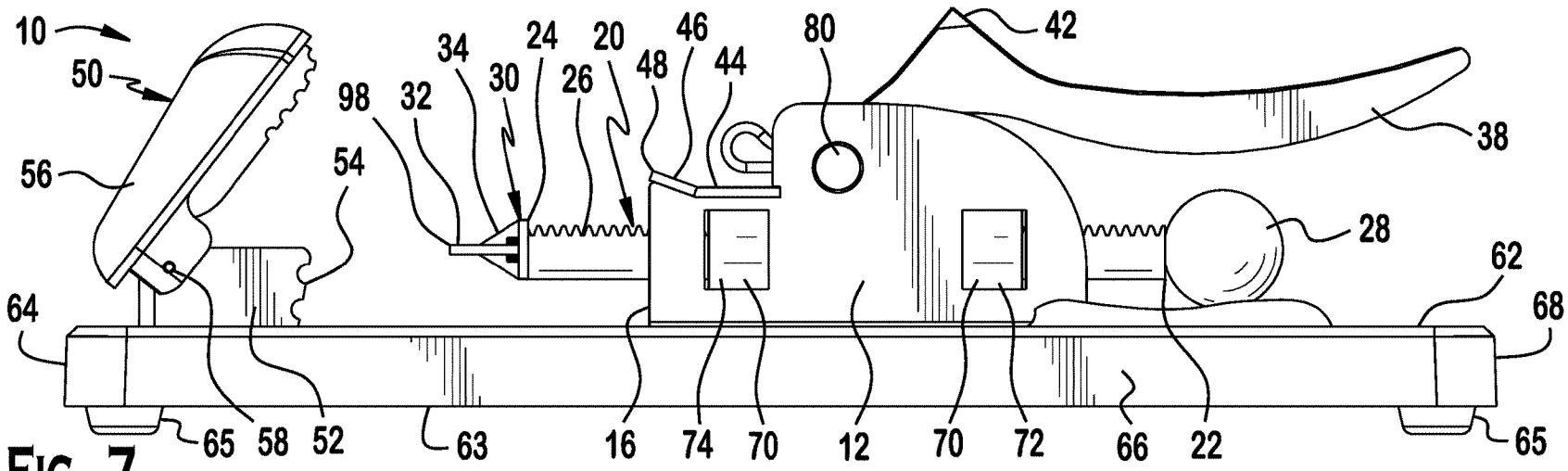
FIG. 7 is a right-side view of an oyster opening device 10 in the preferred embodiment. Here, the housing 12 comprises axial guide 70. The axial guide 70 may further comprise a first axial guide 72 and a second axial guide 74. The first axial guide 72 and the second axial guide 74 may partially enclose the rod 20. The first axial guide 72 and the second axial guide 74 also may partially form the channel 18.

Certain terminology is used in the following description for convenience only and is not limiting. The words "right," "left," "up," and "down" designate the directions as they would be understood by a person facing in the viewing direction unless specified otherwise. At least one of the embodiments of the present invention is accurately represented by this application's drawings which are relied on to illustrate such embodiment(s) to scale and the drawings are relied on to illustrate the relative size, proportions, and positioning of the individual components of the present invention accurately relative to each other and relative to the overall embodiment(s). Those of ordinary skill in the art will appreciate from this disclosure that the present invention is not limited to the scaled drawings and that the illustrated proportions, scale, and relative positioning can be varied without departing from the scope of the present invention as set forth in the broadest descriptions set forth in any portion of the originally filed specification and/or drawings. The words "outer" and "inner" refer to directions away from and toward, respectively, the geometric center of the specified element, or, if no part is specified, the geometric center of the hinge system 10. The terms "downward" and "upward refers to directions above (or away from) and below (or toward) the supporting surface of the oyster opener during operation, respectively, unless specified otherwise. The terms "forward" and "front" refer to a direction in front of the oyster opening device 10, and the term "rear" and back refers to a direction behind the oyster opening device 10. The terms "axial" and "radial" refer to directions along the rod 20 and around the rod 24, respectively. The terms "touching," "abutting," "against," and "contacting" when used in connection with two surfaces is defined as meaning "being positioned anywhere between actual touching of two surfaces to being in facing orientation and within 1 inch (or 2.54 centimeters) apart." Those of ordinary skill in the art will appreciate from this disclosure that skill in the art will appreciate from this disclosure that when a range is provided such as (for example) an angle/distance/number/weight/volume/spacing being between one (1 of the appropriate unit) and ten (10 of the appropriate units) that specific support is provided by the specification to identify any number within the range as being disclosed for use with a preferred embodiment. For example, the recitation of a percentage of copper between one percent (1%) and twenty percent (20%) provides specific support for a preferred embodiment having two point three percent (2.3%) copper even if not separately listed herein and thus provides support for claiming a preferred embodiment having two point three percent (2.3%) copper. By way of an additional example, the recitation in the claims and/or in portions of the specification of the lever preferably only driving the rod when the handle portion of the lever is rotated along the arcuate path in the first direction past the substantial perpendicularity with the supporting surface by at least twenty (20°) degrees, provides specific literal support for any angle greater than twenty (20°) degrees, such as twenty-three (23°) degrees, thirty (30°) degrees, thirty-three-point five (33.5°) degrees, forty-five) (45°) degrees, fifty-two (52°) degrees, or the like. The language "at least one of 'A', 'B', and 'C'," as used in the claims and in corresponding portions of the specification, means "any group having at least one 'A'; or any group having at least one 'B'; or any group having at least one 'C'; —and does require that a group have at least one of each of 'A', 'B', and 'C'." More specifically, the language 'at least two/three of the following list' (the list itemizing items '1', '2', '3', '4', etc.), as used in the claims, means at least two/three total items selected from the list and does not mean two/three of each item in the list. The term "interior", as used in the claims and corresponding portions of the specification means the area proximate to the center of the invention. The term "exterior" similarly defines the area not in proximity to the center of the invention. Additionally, the words "a" and "one" are defined as including one or more of the referenced items unless specifically stated otherwise. The terminology includes the words specifically mentioned above, derivatives thereof, and words of similar import.

Figure 18:
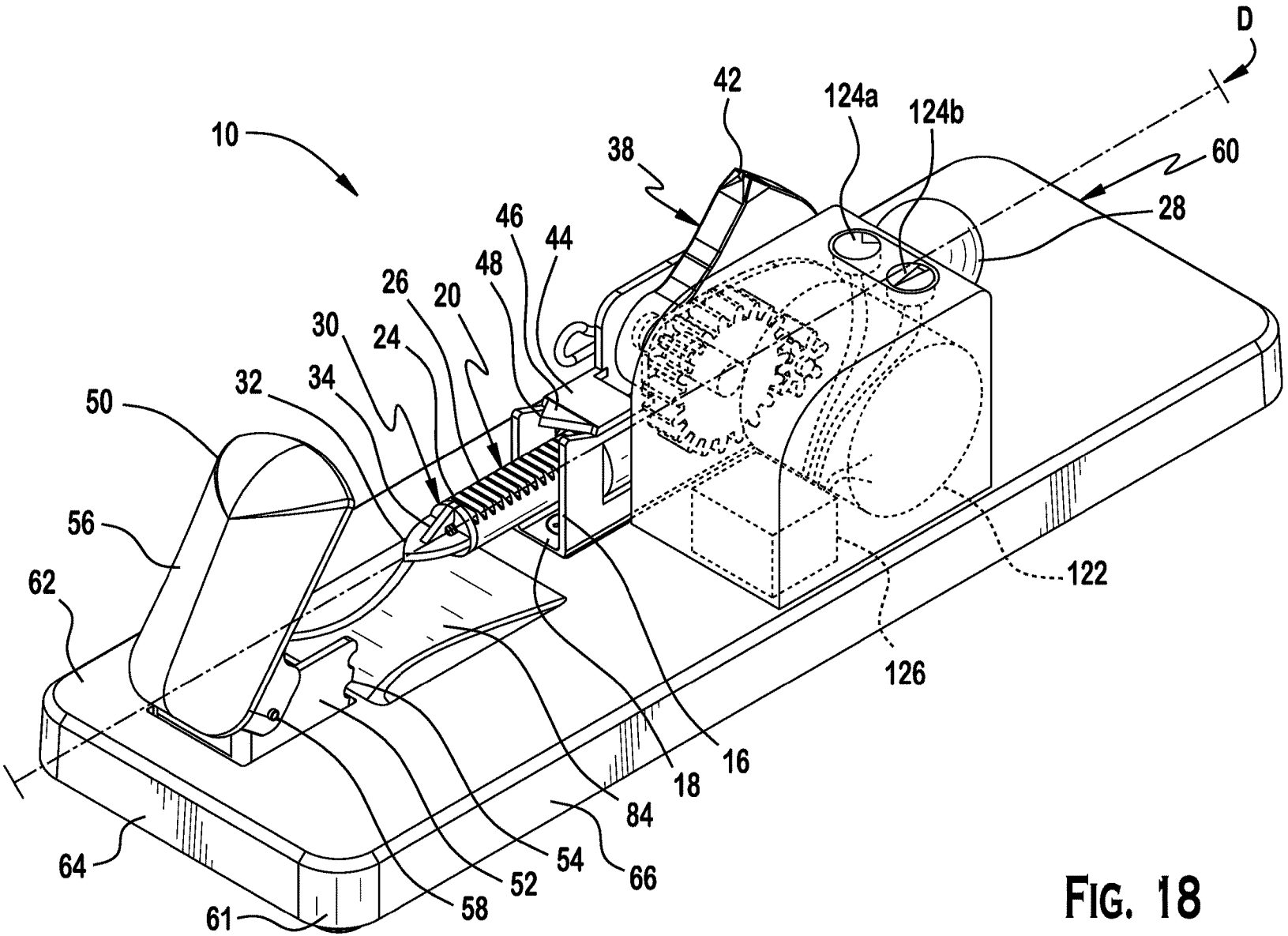
FIG. 18 is a front perspective view of an oyster opening device 10 according to another preferred embodiment of the present invention. This figure shows the oyster opening device 10 comprising a housing 12. The housing 12 preferably comprises a first housing axial end 14 and a second housing axial end 16 on opposite ends of the housing 12. Extending within the housing 12 from the first housing axial end 14 to the second housing axial end 16 is preferably a channel 18 defined therethrough. Extending through the channel 18 may be a rod 20. The rod 20 extends outwardly from the first housing axial end 14 and can form a first rod axial end 22. In the opposite direction, the rod 20 may extend outwardly from the second housing axial end 16 and form a second rod axial end 24. The rod 20 preferably extends along a drive axis D. A motor 122 (which may be electrical, hydraulic, or the like) may be used to drive the oyster opener device. The oyster opener device preferably includes a controller 126 with selectable controls (such as touch pads, buttons, switches, infrared sensors, or the like) 124A, 124B. The controller may be configured that depending on the activation of the selectable controls, that the snipping or chipping operation proceeds and/or that the opening process proceeds. When the controller is released (or no longer depressed or activated) the oyster openers device may automatically return to the fully disengaged default position or may simply stop operation.

Referring generally to FIGS. 1-18, wherein like numerals indicate like elements throughout, an oyster opening device 10 is disclosed in its preferred embodiment. More specifically, the preferred embodiment of the present invention relates to a lever-actuated, rack-and-pinion oyster opening device 10. The present invention may also relate to a method of opening oysters using a lever-actuated, rack-and-pinion oyster opener device. One of ordinary skill in the art would appreciate from this disclosure that the present invention may be used to open a variety of shellfish, shelled objects, and other hard objects that may require a sharp wedge and strong force to open without departing from the scope of the present invention. The device may be entirely manually/hand driven and be free of (and/or not use) any motors, hydraulics, electrical devices, or similar drive producing mechanisms. Referring specifically to FIG. 18, alternatively, those of ordinary skill in the art will appreciate from this disclosure that a motor 122 (which may be electrical, hydraulic, or the like) may be used to drive the oyster opener device. The oyster opener device preferably includes a controller 126 with selectable controls (such as touch pads, buttons, switches, infrared sensors, or the like) 124A, 124B. The controller may be configured that depending on the activation of the selectable controls, that the snipping or chipping operation proceeds and/or that the opening process proceeds. When the controller is released (or no longer depressed or activated) the oyster openers device may automatically return to the fully disengaged default position or may simply stop operation. The motor 122 may be attached to housing directly, located therein, or may be located remotely and in fluid or electric communication therewith. When the control 126 is activated the rod may be driven along the drive axis toward the holder. The oyster opening device 10 may then be configured to split open the oyster 90. The controller 126 may be remotely located such as a desk mounted switch, or a software module on an electronic device/computer, or via a mobile application on a phone or tablet.

Referring generally now to FIGS. 1-12, an oyster opening device 10 may comprise a driving unit 100. The driving unit 100 may comprise a housing 12, a rod 20, and a lever 36. The housing 12 may comprise a first housing axial end 14 and a second housing axial end 16. The first housing axial end 14 and the second housing axial end 16 may be located at opposite ends of the housing 12. The housing 12 may define a channel 18 therein. The channel 18 may extend through the housing 12 and may be further defined by an axial guide 70. The axial guide 70 may further comprise a first axial guide 72 and a second axial guide 74. The first axial guide 72 may be located proximate the first housing axial end 14. Likewise, the second axial guide 74 may be located proximate the second housing axial end 16. "Proximate" preferably means that the first axial guide 72 and the second axial guide 74 are located within one foot (1') of the first housing axial end 14 and the second housing axial end 16, respectively. More preferably, "proximate" means that the first axial guide 72 and the second axial guide 74 are located within six inches (6") of the first housing axial end 14 and the second housing axial end 16, respectively. More preferably still, "proximate" means that the first axial guide 72 and the second axial guide 74 are located within three inches (3") of the first housing axial end 14 and the second housing axial end 16, respectively. Most preferably, "proximate" means that the first axial guide 72 and the second axial guide 74 are located with their outermost edges flush with the first housing axial end 14 and the second housing axial end 16, respectively.

Referring still to FIGS. 1-12, the channel 18, and specifically the axial guide 70, may support a rod 20. The rod 20 may be configured to slide within the channel 18 along a drive axis D. The drive axis D extends between and through the first housing axial end 14 and the second housing axial end 16. The rod 20 may be in sliding contact with the axial guide 70. The rod 20 may be able to swivel radially within the axial guide 70. One of ordinary skill in the art would appreciate from this disclosure that the contact between the rod 20 and the axial guide 70 may be that of any sufficiently low-friction and wear-resistant materials, lubricants, and other suitable elements without departing from the scope of the present invention. The rod 20 may have a first rod axial end 22 and a second rod axial end 24. The first rod axial end 22 may be proximate the first housing axial end 14. Likewise, the second rod axial end 24 may be proximate the second housing axial end 16. The first rod axial end 22 may be detachably affixed to a protuberance 28. One of ordinary skill in the art would appreciate form this disclosure that the protuberance may comprise a ball, a bulb, or other shape with a width greater than the diameter of the axial guide 70 such that the first rod axial end 22 may be prevented from fully longitudinally passing through the first axial guide 72 along the drive axis D without departing from the scope of the present disclosure. Those of ordinary skill in the art will appreciate from this disclosure that the rod 20 may only protrude through the second housing axial end 16 and/or may be a telescoping rod without departing from the scope of the present invention. For example an inner rod may be secured inside the housing proximate the first housing axial end 14 and an outer telescoping rod may be driven by the rack and pinion style mechanism or using any other suitable mechanism without departing from the scope of the present invention.

A wedge 30 may be detachably affixed to the second rod axial end 24. Preferably, the wedge 30 may be sharp and horizontally aligned. The wedge 30 may form a horizontal blade 32. The horizontal blade 32 may form a tip 98. The wedge 30 may further comprise a vertical ramp 34 to induce further spreading of the oyster shell after the horizontal blade 32 cracks the seal. Preferably, the wedge 30 is only used when it is sharp, so a new replacement wedge 30 may be attached when the wedge 30 becomes dull. Additionally, the oyster opener device may include a plurality of interchangeable wedges such that a user can select the most appropriate size, material, etc. for use with a particular type of oyster or other shellfish.

Further, the oyster opening device 10 may comprise a lever 36. The lever 36 may comprise a handle portion 38. The handle portion 38 may be gripped and manipulated by the user of the device. The lever 36 may be connected to the housing 12 via a bolt 80. The bolt 80 may extend through both holes both in the housing 12 and the lever 36. The bolt 80 may allow for the pivotal rotation of the lever 36 about the housing 12. The bolt 80 may be held in place and inhibited from slipping axially by a pin 82. On of ordinary skill in the art would appreciate from this disclosure that the bolt 80 may be replaced by any suitable rod, beam, screw, bolt, or other element capable of affixing the handle 36 to the housing 12 while allow for the rotation of the handle 36 relative to the housing 12 without departing form the scope of the present disclosure. The lever 36 may extend into the channel 18.

The oyster opening device 10 may, but does not necessarily, include a holder 50. The holder 50 may be located a predetermined distance away from and may be axially aligned along the drive axis D with, the housing 12. The holder 50 may comprise a holder base 52 that does not move relative to the housing 12. The holder base 52 may comprise a groove 54 to accommodate a hinge 94 of an oyster 90. One of ordinary skill in the art would appreciate form this disclosure that the groove 54 may be multiple grooves or any other indentation suitable for receiving and preventing slippage of an oyster 90 being opened without departing from the scope of the present disclosure. The holder 50 may also comprise a hand grip 56 attached to the holder base 52 by a holder hinge 58. The holder hinge 58 may allow for rotation of the hand grip 56 relative to the holder base and to clamp down on the top shell of an oyster 90 in order to further reduce the slippage of the oyster 90 during the opening process as well as protect the hand of a user by physically distancing it from the wedge 30. The holder 50 may comprise a holding portion 102.

Still referring to FIGS. 1-12, the housing 12 and the holder 50 may be movably attached, or detachably affixed, to a baseboard 60. The baseboard 60 may be flat. The baseboard 60 may contact a supporting surface 108 located below the oyster opener device 10. The oyster opener device may comprise the baseboard 60. The baseboard 60 may comprise a baseboard top 62 and a baseboard bottom 64. The housing 12 and the holder 50 may be connected to the baseboard top 62. The baseboard 60 may further comprise rounded corners 61 connecting a baseboard front 64, baseboard sides 66, and a baseboard back 68. The baseboard 60 may be rectangular. One of the ordinary skill in the art would appreciate form this disclosure that the baseboard 60 may comprise any substantially flat shape capable of supporting the driving unit 100 and the holding portion 102 in axial alignment without departing form the scope of the present invention. The housing 12 may be located toward the baseboard back 68, and the holder 50 may be located toward the baseboard front 64.

The baseboard may optionally define a slot 86 therein. The slot 86 may accommodate the storage of a utensil 88. The utensil 88 may be an oyster knife or any other tool desired for supplementing the opening of an oyster 90 by the oyster opening device 10. The baseboard may also optionally define an indentation 84. The indentation 84 may extend from the second housing axial end 16 to the holder base 52. The indentation 84 may accommodate a portion of an oyster shell that protrudes from an oyster's underside.

Figure 8:
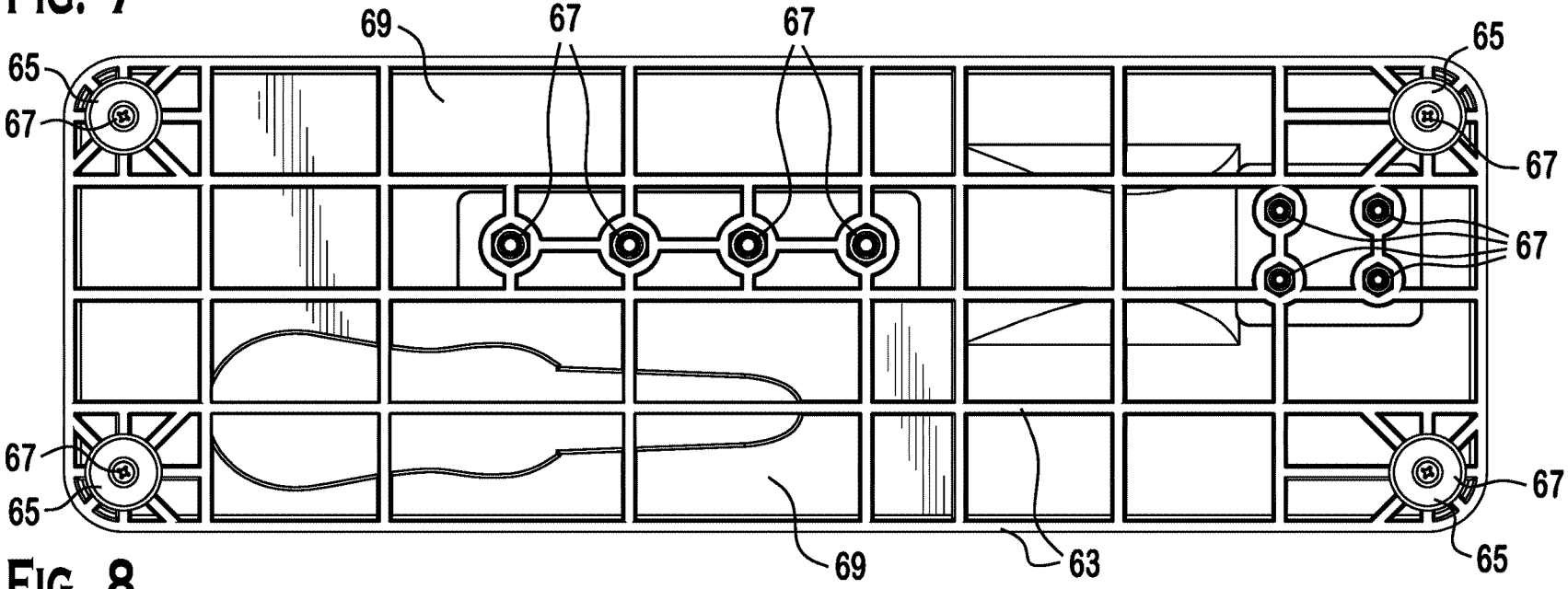
FIG. 8 is a bottom view of an oyster opening device 10 in the preferred embodiment. Here, the baseboard bottom 63 of the baseboard 60 can be seen. The baseboard bottom 63 may comprise feet 65. The feet 65 may be designed to contact the supporting surface 108. The baseboard bottom 63 may also have hollowed out sections 69. The various elements connected to the baseboard top 62 preferably are connected via a plurality of fasteners 67 also seen extending along the baseboard bottom 63.
Figure 9:
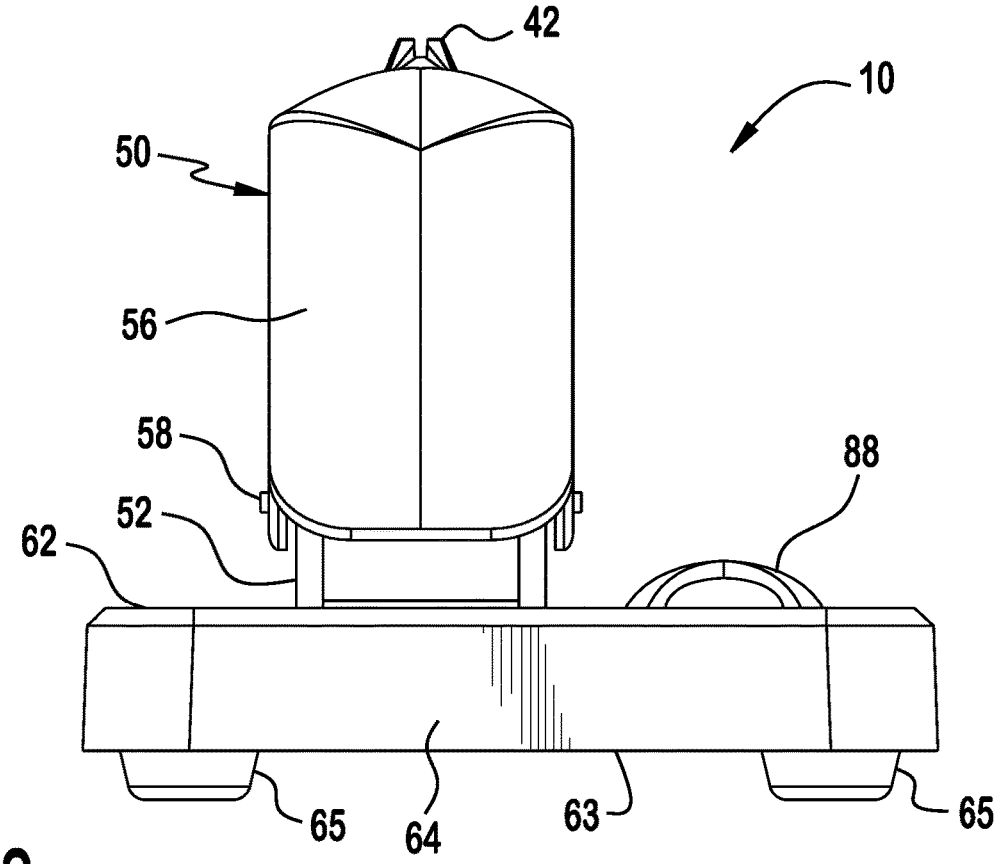
FIG. 9 is a front view of an oyster opening device 10 in the preferred embodiment. This figure illustrates how neither the holder 50 nor the slot 86 may be centered along the baseboard 60 in the preferred embodiment of the present invention.
Figure 10:
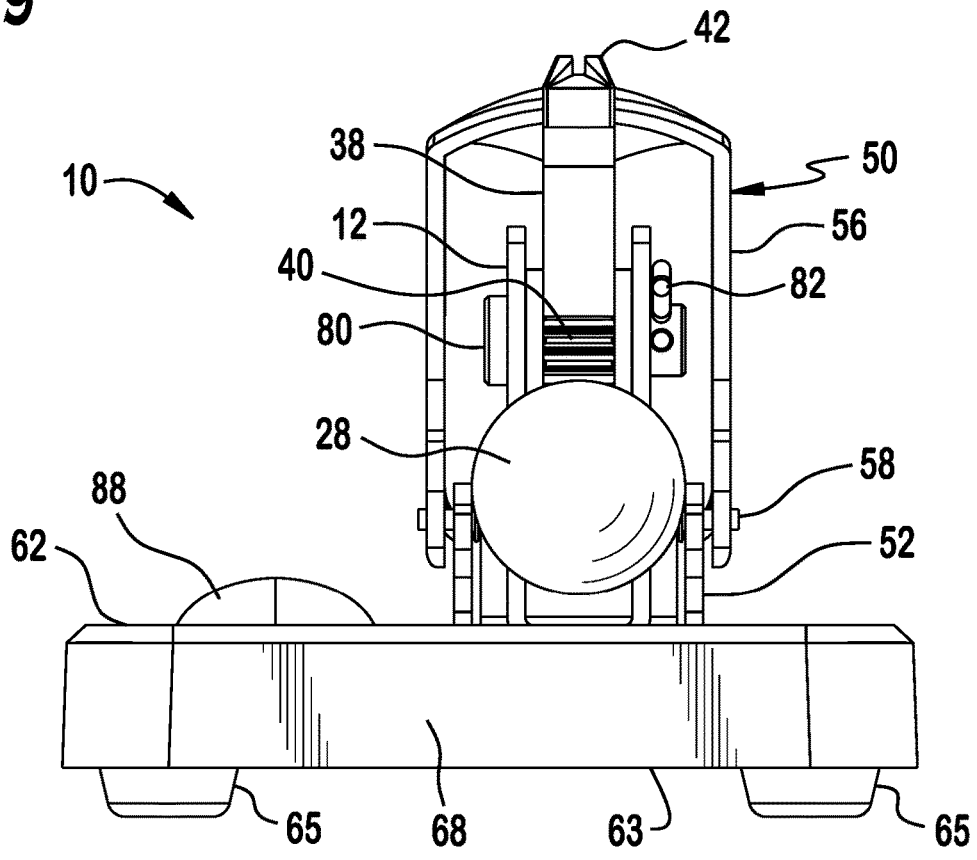
FIG. 10 is a rear view of an oyster opening device 10 in the preferred embodiment. Here, the lever 36 may also comprise a gear-like section 40. The gear-like section 40 is preferably designed to engage with the plurality of splined grooves 26 of the rod 20. This figure also illustrates how the protuberance 28 is preferably wider than the channel 18 defined through the housing 12.
Figure 11:
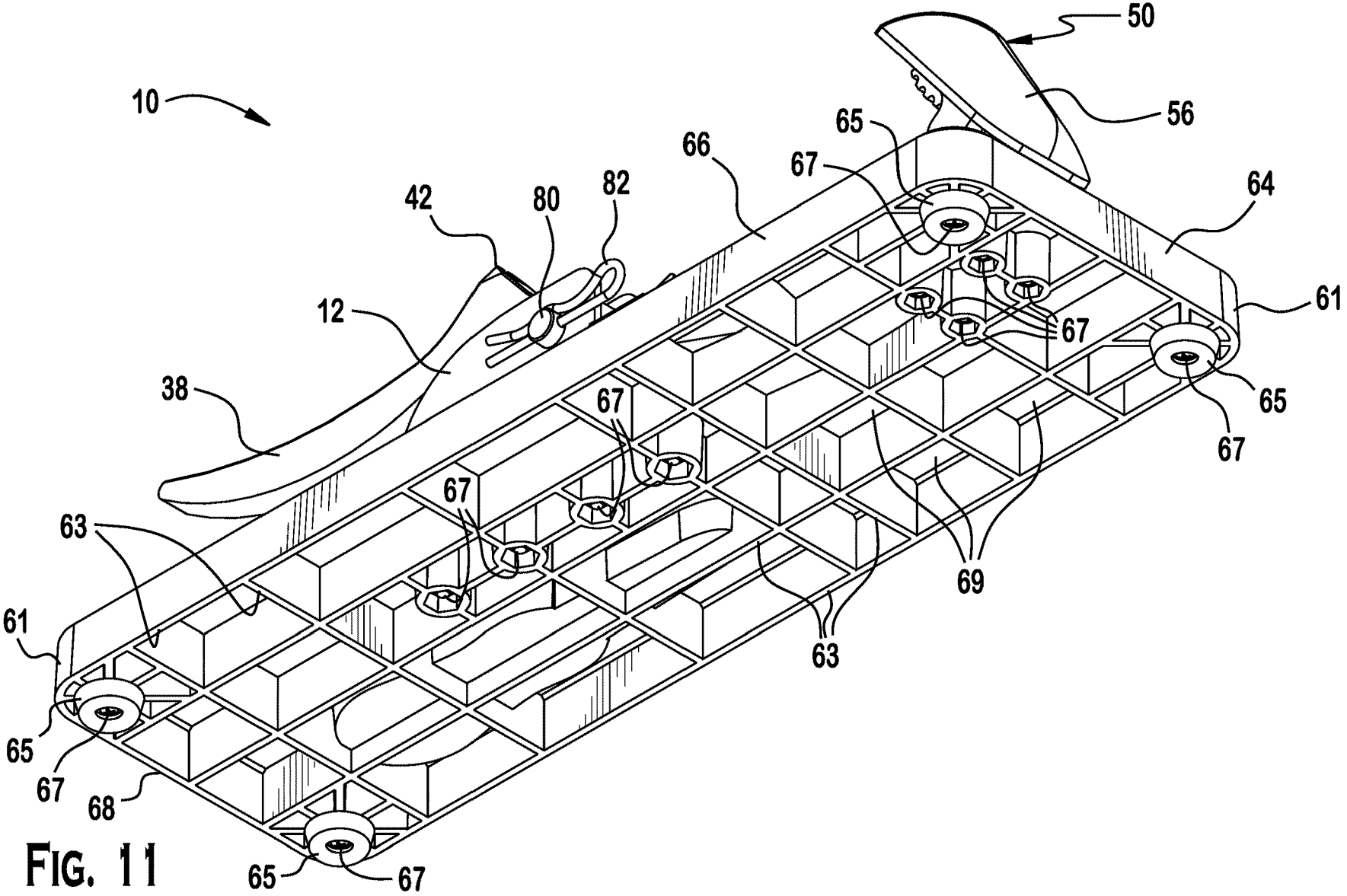
FIG. 11 is a bottom perspective view of an oyster opening device 10 in the preferred embodiment.
Figure 12:
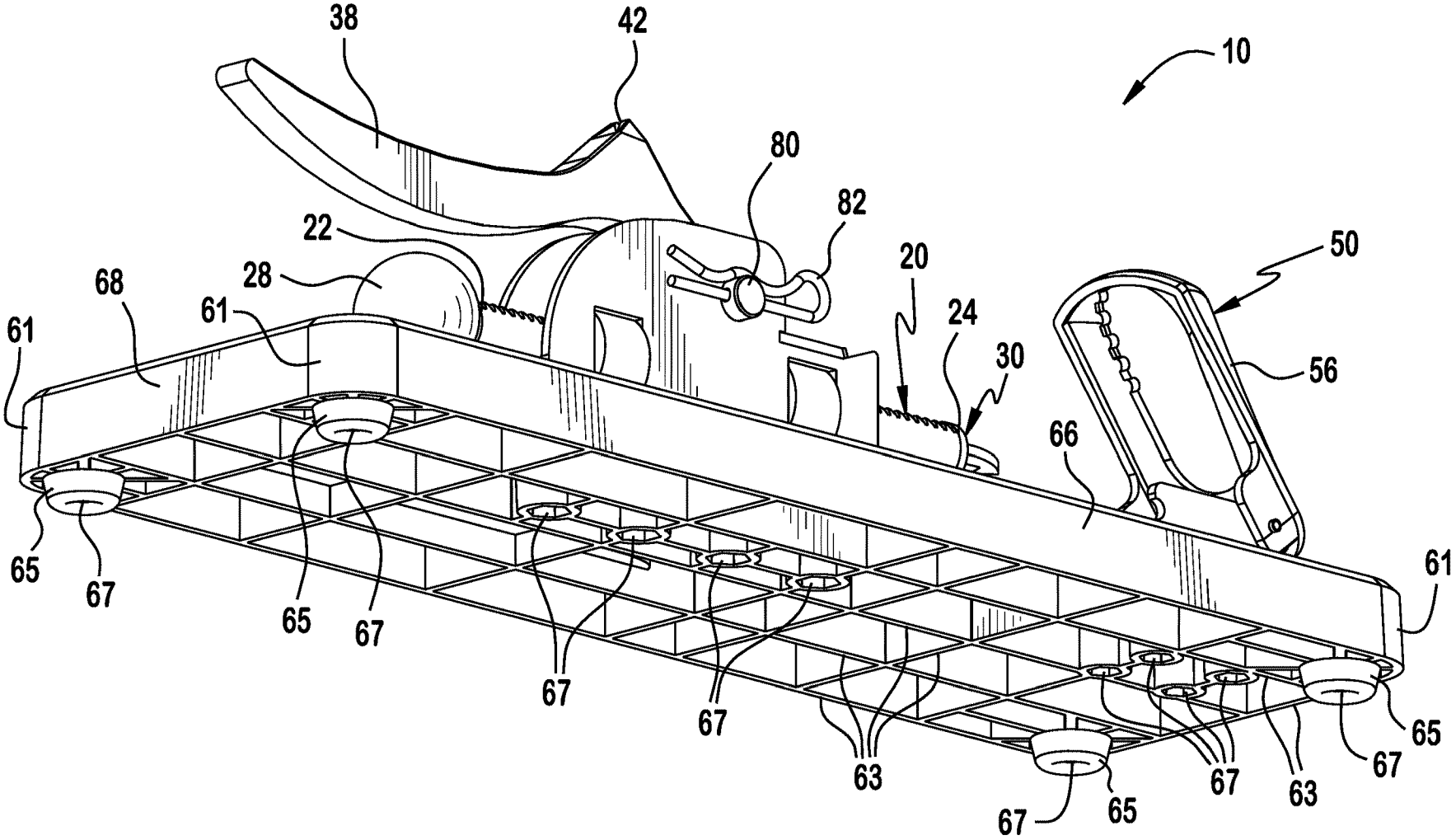
FIG. 12 is an alternative bottom perspective view of an oyster opening device 10 in the preferred embodiment.

Referring specifically to FIGS. 8, 11 and 12, the baseboard 60 may comprise a baseboard bottom 63. The baseboard bottom 63 may comprise feet 65 designed to contact the supporting surface 108. One of ordinary skill in the art would appreciate form this disclosure that the feet 65 may comprise any suitably gripping material for traction on the supporting surface 108 as desired or may be omitted entirely without departing form the scope of the present invention. The feet 65 may be detachably affixed by a plurality of fasters 67. As can be seen more clearly from these figures, the fasteners 67 extending upwardly through the baseboard 60 are also what may be used to detachably affix the other elements to the baseboard top 62. The baseboard bottom 63 may also comprise hollowed-out sections 69. The hollowed-out sections 69 may be advantageous to reduce the overall material cost as well as the weight of the device without sacrificing overall structural integrity.

One of ordinary skill in the art would appreciate from this disclosure that the baseboard 60 as well as each of the various elements recited in this specification may be constructed from any plastics or polymers via injection molding, metals or metal alloys, or any other suitably strong, cheap to manufacture, lightweight, and wear-resistant materials without departing from the scope of the present invention. The baseboard 60 may be detachably-mounted to the supporting surface 108 via suction, clamping, or any other suitable means of affixing the baseboard 60 to the supporting surface without departing from the scope of the present disclosure. The baseboard 60 may also simply rest on the supporting surface 108 without being mounted to supporting surface 108.

Figure 13:
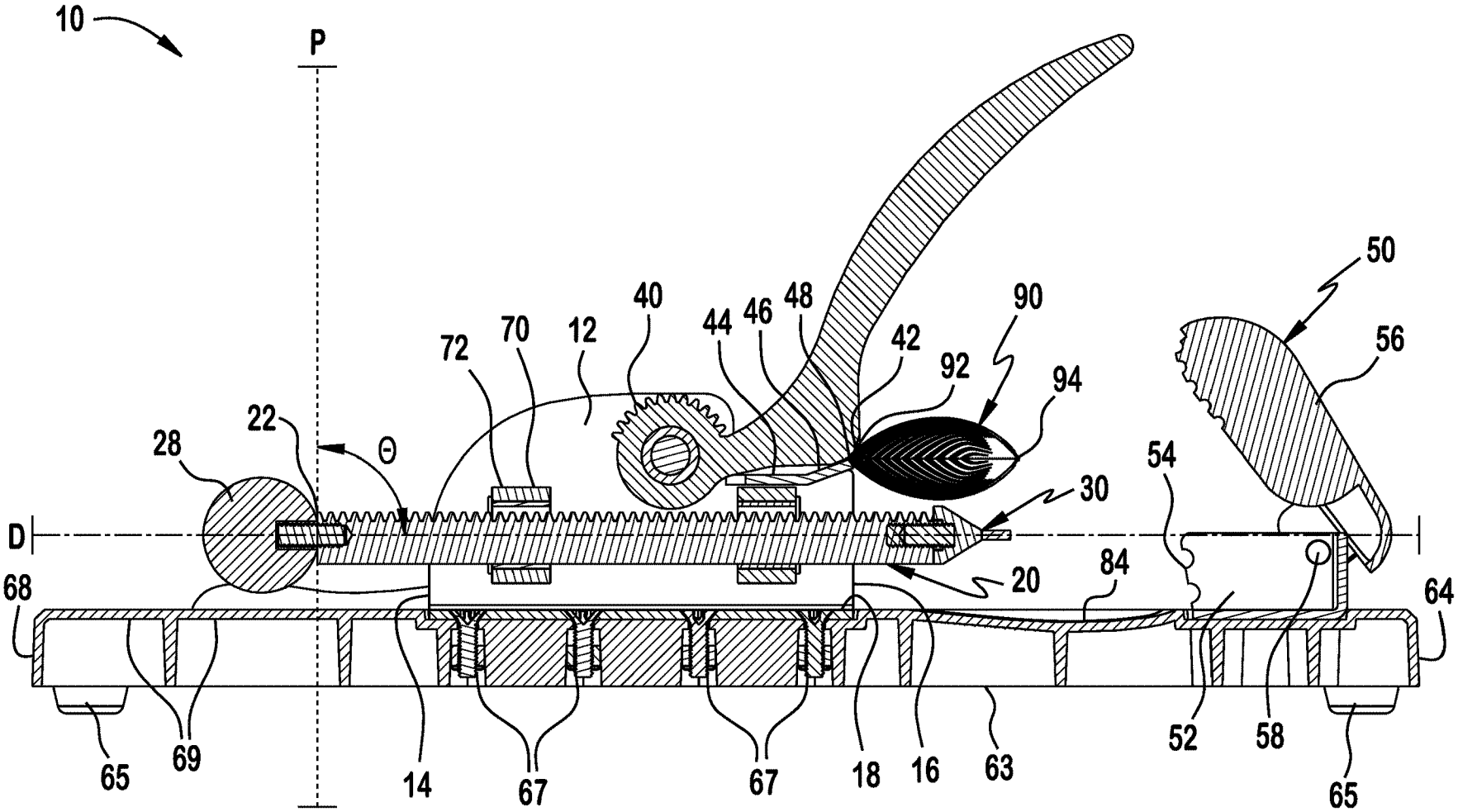
FIG. 13 is a side cross-sectional view of an oyster opening device 10 in the preferred embodiment. Here, an oyster 90 can be seen positioned with its bill 92 located between the snipper 42 and the point contact 48 of the plate 46. The snipper 42 and the point contact 48 may create a compressive force on the bill 92 and form a crack 96. The opposite end of the oyster 90 can also be seen. This end is commonly referred to as a hinge 94. This figure also illustrates a perpendicular axis P which may be perpendicular to the drive axis D. The perpendicular axis P may serve as a reference for measuring a rod angle θ against the drive axis D.

Referring now to FIG. 13, the oyster opening device 10 may be seen in cross-section. An oyster 90 may comprise a bill 92 and a hinge 94. The bill 92 of the oyster 90 may be placed on the point contact 48 of the blade 46 connected to the oyster contact plate 44. A user of the device may engage the lever 36 and rotated along the arcuate path A toward the baseboard front 63. A stepper 42 may contact the bill 92 of the oyster 90 opposite the point contact 48. The pressure between the snipper 42 and the point contact 48 may form a crack in a portion of the shell of the oyster 90. The perpendicular axis P can also be seen. The perpendicular axis P may be perpendicular to the drive axis D. A rod angle θ may be measured from the perpendicular axis P to the rod 20. One of ordinary skill in the art will appreciate from this disclosure that the perpendicular axis P may be shifted toward any point along the drive axis D to measure the rod angle θ or any other angles that may be desired according to design specifications without departing from the scope of the present invention.

Figure 14:
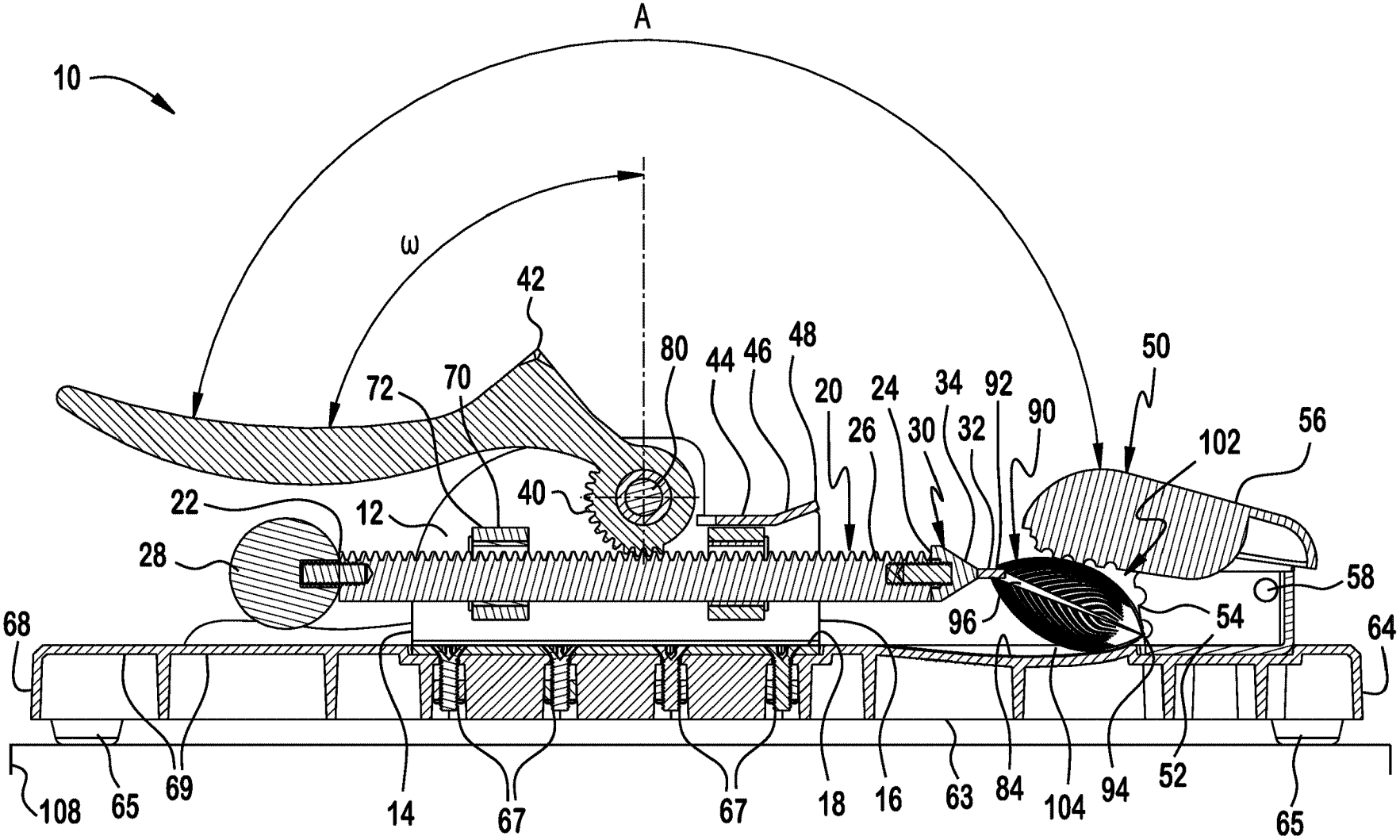
FIG. 14 is a side cross-sectional view of an oyster opening device 10 in the preferred embodiment. Here, an oyster 90 can be seen in a generally flat and horizontal position 104 with a tip 98 of the wedge 30 located within the crack 96 formed within its bill 92. The hinge 94 is seen partially accommodated by the groove 54 of the holder 50. The handgrip 56 of the holder 50 may also contact the oyster 90. The lever 36 is seen here rotated along the arcuate path A from the position shown in FIG. 13. This figure also illustrates how the gear-like section 40 of the lever may be engaged with the plurality of splined grooves 26 of the rod 20. The baseboard 60 also may contact and sit on a supporting surface 108. A lever angle ω is also seen measured from the perpendicular axis P that has now been shifted to be centered on the bolt 80.

Referring now to FIGS. 13 and 14, the lever may comprise a gear-like section 40. The gear-like section 40 may be configured to engage with the plurality of splined groups 26 of the rod 20. In FIG. 13, the gear-like section 40 may not be engaged with the plurality of splined grooves 26 so that the lever 36 may be fully rotated toward the baseboard front 64 and the snipper 42 in the point contact 48 may form a crack 96 in a portion of the shell the oyster 90. The advantage of the gear-like section 40 and the plurality of splined grooves 26 not being engaged may be that the rod 20 can be axially adjusted by a user of the device before splitting open the oyster. However, in FIG. 14, the gear-like section 40 is fully engaged with the plurality of splined grooves 26. The gear-like section 40 engaged with the plurality of splined grooves 26 may form the driving unit 100. The driving unit 100 may comprise a rack-and-pinion system. One of ordinary skill in the art would appreciate from this disclosure that a similar device capable of translating force, power, and pressure into a horizontal direction along the longitudinal axis may be substituted for the rack-and-pinion system without departing from the scope of the present invention. For example, the oyster opening device may include a hydraulic drive system, an electrical motor, or any other suitable powered drive mechanism to operate without departing from the scope of the present invention. Similarly, one of ordinary skill in the art would appreciate from this disclosure that the rack-and-pinion system may also be operated via any suitably strong electrical, mechanical, or manual mechanisms by hydraulics, pistons, motors, or the like without departing from the scope of the present invention. Depending on the mechanism used to drive and operate the oyster opener device, the oyster opening device may omit the lever without departing from the scope of the present invention. Similarly, the oyster opener device may include a detachable lever such that a user can operate the device via hand power, with the powered drive system, or have the option of a manually operated lever with a powered assist.

The gear-like section 40 may be at least partially contained within the housing 12. "At least partially contained" preferably means that the gear-like section 40 is at least fifty percent (50%) enclosed by the housing 12. More preferably, "at least partially contained" means that the gear-like section 40 is at least seventy-five percent (75%) enclosed by the housing 12. Most preferably, "at least partially contained" means that the gear-like section 40 is fully enclosed by the housing 12.

Referring now to FIG. 14, the perpendicular axis P has been shifted to be centered on the bolt 80. The shifted perpendicular axis P may allow a lever angle ω to be measured from the handle portion 38 of the lever 36. The gear-like section 40 may only engage the plurality of splined grooves 26 once the lever 36 has been moved in the first direction past substantial perpendicularity with the supporting surface 108. "Past substantial perpendicularity" preferably means that the lever angle ω is at least one degree (1°). More preferably, "past substantial perpendicularity" means that the lever angle ω is at least ten degrees (10°). More preferably still, "past substantial perpendicularity" means that the lever angle ω is at least twenty degrees (20°). Most preferably, "past substantial perpendicularity" means that the lever angle ω is at least forty-five degrees (45°).

Referring still to FIG. 14, the oyster 90 may be held in a generally flat and horizontal position 104 while it is split by the oyster opening device 10. The tip 98 of the wedge 30 may be positioned within the crack 96 formed in the bill 92 of the oyster 90. The hinge 94 of the oyster 90 is positioned within one of the grooves 54 of the holder 50. The handgrip 56 may be rotated down to clamp down on the top of the shell the oyster 90. The bottom of the shell the oyster 90 may be positioned within the indentation 84 to further reduce slippage. Once the tip 98 of the wedge 30 may be positioned within the crack 96, the rack-and-pinion system of the lever 36 and the rod 20 may be fully engaged in order to drive the wedge 30 along the drive axis D and through the bill 92 of the oyster 90 and split open the oyster 90. "A generally flat and horizontal position" preferably means that the angle between the seam of the oyster 90 and of the drive axis D is no greater than thirty degrees (30°). More preferably, "a generally flat and horizontal position" means that the angle between the seam of the oyster 90 and of the drive axis D is no greater than twenty degrees (20°). More preferably still, "a generally flat and horizontal position" means that the angle between the seam of the oyster 90 and of the drive axis D is no greater than ten degrees (10°). Most preferably, "a generally flat and horizontal position" means that the seam of the oyster 90 and of the drive axis D are parallel.

One of the many advantages of this oyster opening device 10 may be that the oysters are opened horizontally. By opening oysters horizontally and allowing them to remain so during the opening process may allow for the internal juices of the oyster to be preserved even after the shell has been opened.

Figure 15:
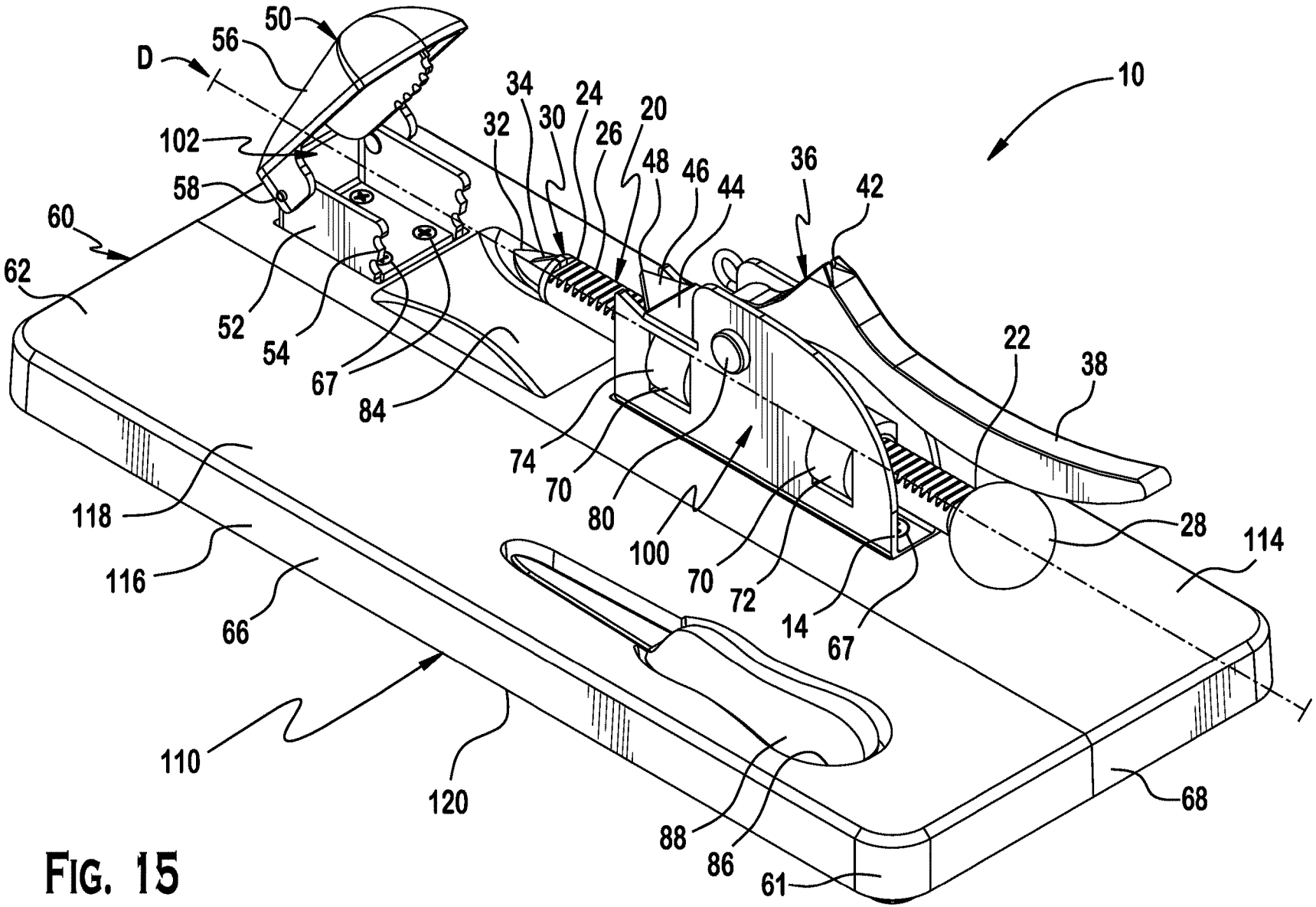
FIG. 15 is a front perspective view of an oyster opening device 10 in the alternative preferred embodiment. Here, it can be seen that the baseboard 60 preferably comprises a foldable baseboard 110. The foldable baseboard 110 may comprise a first baseboard section 114 and a second baseboard section 116. The first baseboard section 114 may be connected to the second baseboard section 116 by a baseboard hinge 112. The separation of the first baseboard section 114 from the second baseboard section 116 is preferably along a longitudinal axis L.

Referring now to FIGS. 15-17, an alternative preferred embodiment of the oyster opening device 10 may be seen. The driving unit 100 in the holding portion 102 may now be seen detachably affixed to a foldable baseboard 110. The foldable baseboard 110 may be comprised of two or more connectable, foldable pieces. The foldable baseboard 110 may comprise a first baseboard section 114 and a second baseboard section 116 connected by a baseboard hinge 112. In the configuration shown, the housing 12, the indentation 84, and the holder 50 may be positioned and detachably affixed to the first baseboard section 114. The second baseboard section 116 made define the slot 86 for storage of a utensil 88.

Referring now to FIG. 15, a longitudinal axis L may be defined along the edge separating the first baseboard section 114 from the second baseboard section 116. The baseboard hinge 112 may lie along the baseboard bottom 63 of the foldable baseboard 110 and along the longitudinal axis L.

Referring now to FIG. 16, the foldable baseboard 110 comprises a first major surface 118 along the baseboard top 62 and a second major surface 120 along the baseboard bottom 63. The full baseboard 110 may be in the extended position when the first major surface 118 of the first baseboard section 114 is co-linear with the first major surface 118 of the second baseboard section 116.

Referring now to FIG. 17, the foldable baseboard 110 may be in a folded position. In the folded position, the second major surface 120 of the second baseboard section 116 is folded against the second major surface 120 of the first baseboard section 114. The feet 65 may contact one another and prevent the second major surfaces 120 of the first baseboard section 114 and the second baseboard section 116 from fully touching. Advantages of the board being comprised of two or more connected, foldable pieces may be that the board is easier to move, disassemble, assemble, and clean. One of ordinary skill in the art would appreciate from this disclosure that the two or more connectable, foldable pieces may be connected by hinges, channel locks, or the like without departing from the scope of the present invention.

The oyster opener device may be used to open an oyster by a user according to the following steps. A small piece of the oyster shell may be placed on the pointed section of the housing and the top piece of the oyster shell opposite may be contacted by the wedged portion. The user then may apply a downward force to the lever in order to form a crack in the bill of the oyster using the snipper. The hinge of the oyster may then be placed in the holding portion and the tip of the splitting wedge may be positioned within the crack by pulling the rod toward the oyster. Once the splitting wedge is in position within the crack, the user may engage the lever by gripping the handle and pulling away from the oyster. At a predetermined point, the pinion may then engage with the rack located along the top of the rod. The force applied to the lever by the user pulling the lever may then be translated into a longitudinal force exerted by the rod onto the oyster. The force applied by the splitting wedge directly into the crack in the bill of the oyster may then split the seal on the oyster shell. The vertical component of the splitting wedge may further separate the top shelf from the bottom shell. The user may then release the tension in the shell and remove the shell from the device. An oyster knife may then be used to disconnect the remaining tissues within the oyster. One of ordinary skill in the art would appreciate from this disclosure that the steps mentioned above may be completed in any order, additional steps may be added, or existing steps may be omitted without departing from the scope of the present invention.

Further advantages of this device may be that the hands of the user may be safe by the use of the gripping portion that physically separates a user's hand from the area in which the splitting wedge is opening the oyster. Another advantage of this device may be that oysters can be opened at a rate much higher than they can be opened by hand using a typical oyster knife.

One of ordinary skill in the art will appreciate from this disclosure that the various components and elements of the present invention may be constructed of any suitably strong, wear-resistant, flexible (where desired), and inexpensive metals, polymers, alloys, plastics, and other materials without departing from the scope of the present invention.

One of ordinary skill in the art will appreciate from this disclosure that device elements, as well as materials, shapes and dimensions of device elements, as well as methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed, described in the specification, and/or shown in the figures. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention.

What is claimed is:

1. An oyster opening device, comprising:

a housing defining a channel therein and having first and second housing axial ends;

a rod having first and second rod axial ends and being moveably located in the channel along a drive axis;

a wedge positioned on the second rod axial end;

a lever positioned on the housing and configured to drive the rod along the drive axis, the lever being configured to move through an arcuate path about the housing;

a holder which is positionally fixed relative to the housing;

wherein the oyster opener device is configured to hold an oyster, when the lever is rotated in a first direction along the arcuate path toward the first housing axial end the rod is driven along the drive axis toward the holder, the oyster opening device being configured to split open the oyster positioned thereon when the wedge is driven toward the holder, wherein the housing further comprises an oyster contact plate, the lever having a snipper thereon, when the lever is rotated in a second direction along the arcuate path toward the second housing axial end the snipper is moved toward the oyster contact plate, wherein the snipper and the oyster contact plate are configured to form a crack in an unopened oyster positioned therebetween, and wherein the oyster contact plate defines a blade configured to form a point contact with the oyster, the point contact engaging an opposite side of the oyster from the snipper to assist the snipper in forming the crack.

2. The device of claim 1, wherein a tip of the wedge is configured for placement into the crack of the oyster to facilitate stability in the holding thereof when the wedge splits the oyster.

3. The device of claim 1, wherein the oyster opener device is configured to hold the oyster in a generally flat and horizontal position during splitting to reduce an amount of oyster fluid which leaves the oyster during splitting.

4. The device of claim 3, wherein the oyster opener device is configured to hold the oyster in the generally flat and horizontal position when the oyster is abuttingly positioned between the holder and wedge, the holder being positioned along the drive axis.

5. The device of claim 1, wherein the wedge comprises a horizontal blade and a vertical ramp, the horizontal blade extending further from the rod along the drive axis than the vertical ramp, the vertical ramp assisting the horizontal blade in splitting open the oyster.

6. The device of claim 1, wherein the oyster opener device is configured for placement on a supporting surface, wherein the oyster opener device is configured such that rotation of the lever in the first direction toward the first housing axial end only drives the rod and the wedge toward the holder if the rotation of the lever creates a compressive force between the lever and the supporting surface.

7. The device of claim 1, wherein the lever includes a handle portion, the oyster opener device being configured for placement on a supporting surface, the lever only driving the rod toward the holder once the handle portion has been rotated along the arcuate path in the first direction past substantial perpendicularity with the supporting surface.

8. The device of claim 1, wherein the lever includes a handle portion, the oyster opener device being configured for placement on a supporting surface, the lever only driving the rod toward the holder once the handle portion has been rotated along the arcuate path in the first direction past substantial perpendicularity with the supporting surface by at least twenty(20°) degrees; a motor attached to the housing to provide a powered assist to the lever such that amount of manual force needed by a user to operate the oyster opener device is reduced.

9. The device of claim 1, further comprising:

the lever having a gear-like section thereon, the gear like section being at least partially located within the housing; and the rod having a plurality of splined grooves configured to engage the gear-like section of the lever, wherein the oyster opener device is configured to be entirely manually operated and hand driven such that the oyster opener device is entirely free of any motors, any hydraulics, and any electrical devices.

10. An oyster opening device, comprising:

a housing defining a channel therein and having first and second housing axial ends;

a rod having first and second rod axial ends and being moveably located in the channel along a drive axis;

a wedge positioned on the second rod axial end;

a lever positioned on the housing and configured to drive the rod along the drive axis, the lever being configured to move through an arcuate path about the housing;

a holder which is positionally fixed relative to the housing;

wherein the oyster opener device is configured to hold an oyster, when the lever is rotated in a first direction along the arcuate path toward the first housing axial end the rod is driven along the drive axis toward the holder, the oyster opening device being configured to split open the oyster positioned thereon when the wedge is driven toward the holder, and wherein the housing has an axial guide partially defining the channel, a protuberance located on the first rod axial end, the protuberance being configured to abut the axial guide to prevent the rod from moving completely past the first housing axial end when moving toward the second housing axial end.

11. An oyster opening device, comprising:

a housing defining a channel therein and having first and second housing axial ends;

a rod having first and second rod axial ends and being moveably located in the channel along a drive axis;

a wedge positioned on the second rod axial end;

a lever positioned on the housing and configured to drive the rod along the drive axis, the lever being configured to move through an arcuate path about the housing;

a holder which is positionally fixed relative to the housing;

wherein the oyster opener device is configured to hold an oyster, when the lever is rotated in a first direction along the arcuate path toward the first housing axial end the rod is driven along the drive axis toward the holder, the oyster opening device being configured to split open the oyster positioned thereon when the wedge is driven toward the holder, and wherein the holder has a holder base which defines a groove therein, the groove being configured to receive a portion of the oyster therein; wherein the lever is detachable from the housing; wherein the holder further comprises a hand grip, the hand grip being pivotally attached to the holder base, the hand grip being configured to press down on the oyster abutting the holder base.

12. An oyster opening device, comprising:

a housing defining a channel therein and having first and second housing axial ends;

a rod having first and second rod axial ends and being moveably located in the channel along a drive axis;

a wedge positioned on the second rod axial end;

a lever positioned on the housing and configured to drive the rod along the drive axis, the lever being configured to move through an arcuate path about the housing;

a holder which is positionally fixed relative to the housing; and a baseboard configured to contact a supporting surface, the baseboard being foldable along a longitudinal axis parallel to the drive axis to form first and second baseboard sections, the first baseboard section having first and second major surfaces, the base board being foldable such that the device and holder are positioned on the first major surface of the first baseboard section and such that the second baseboard section is folded against the second major surface of the first baseboard section;

wherein the oyster opener device is configured to hold an oyster, when the lever is rotated in a first direction along the arcuate path toward the first housing axial end the rod is driven along the drive axis toward the holder, the oyster opening device being configured to split open the oyster positioned thereon when the wedge is driven toward the holder.

13. An oyster opening device, comprising:

a housing defining a channel therein and having first and second housing axial ends;

a rod having first and second rod axial ends and being moveably located in the channel along a drive axis;

a wedge positioned on the second rod axial end;

a lever positioned on the housing and configured to drive the rod along the drive axis, the lever being configured to move through an arcuate path about the housing;

a holder which is positionally fixed relative to the housing;

wherein the oyster opener device is configured to hold an oyster, when the lever is rotated in a first direction along the arcuate path toward the first housing axial end the rod is driven along the drive axis toward the holder, the oyster opening device being configured to split open the oyster positioned thereon when the wedge is driven toward the holder, and wherein the wedge is detachably positioned on the second rod axial end.

14. The device of claim 13, wherein the oyster opener device is configured to hold the oyster in a generally flat and horizontal position during splitting to reduce an amount of oyster fluid which leaves the oyster during splitting.

15. The device of claim 14, wherein the oyster opener device is configured to hold the oyster in the generally flat and horizontal position when the oyster is abuttingly positioned between the holder and wedge, the holder being positioned along the drive axis.

16. The device of claim 13, wherein the wedge comprises a horizontal blade and a vertical ramp, the horizontal blade extending further from the rod along the drive axis than the vertical ramp, the vertical ramp assisting the horizontal blade in splitting open the oyster.

17. The device of claim 13, wherein the oyster opener device is configured for placement on a supporting surface, wherein the oyster opener device is configured such that rotation of the lever in the first direction toward the first housing axial end only drives the rod and the wedge toward the holder if the rotation of the lever creates a compressive force between the lever and the supporting surface.

18. The device of claim 13, wherein the lever includes a handle portion, the oyster opener device being configured for placement on a supporting surface, the lever only driving the rod toward the holder once the handle portion has been rotated along the arcuate path in the first direction past substantial perpendicularity with the supporting surface.

19. The device of claim 13, wherein the lever includes a handle portion, the oyster opener device being configured for placement on a supporting surface, the lever only driving the rod toward the holder once the handle portion has been rotated along the arcuate path in the first direction past substantial perpendicularity with the supporting surface by at least twenty(20°) degrees; a motor attached to the housing to provide a powered assist to the lever such that amount of manual force needed by a user to operate the oyster opener device is reduced.

20. An oyster opening device, comprising:

a housing defining a channel therein and having first and second housing axial ends;

a rod having first and second rod axial ends and being moveably located in the channel along a drive axis;

a wedge positioned on the second rod axial end;

a lever positioned on the housing and configured to drive the rod along the drive axis, the lever being configured to move through an arcuate path about the housing;

a holder which is positionally fixed relative to the housing; and a baseboard, the housing and the holder being positioned on the baseboard, the baseboard defining a slot, the slot being configured to store a utensil;

wherein the oyster opener device is configured to hold an oyster, when the lever is rotated in a first direction along the arcuate path toward the first housing axial end the rod is driven along the drive axis toward the holder, the oyster opening device being configured to split open the oyster positioned thereon when the wedge is driven toward the holder.

* * * * *